US008746197B2

(12) United States Patent
McAlister

(10) Patent No.: US 8,746,197 B2
(45) Date of Patent: Jun. 10, 2014

(54) FUEL INJECTION SYSTEMS WITH ENHANCED CORONA BURST

(71) Applicant: McAlister Technologies, LLC, Phoenix, AZ (US)

(72) Inventor: Roy Edward McAlister, Phoenix, AZ (US)

(73) Assignee: McAlister Technologies, LLC, Phoenix, AZ (US)

( * ) Notice: Subject to any disclaimer, the term of this patent is extended or adjusted under 35 U.S.C. 154(b) by 0 days.

(21) Appl. No.: 13/844,488

(22) Filed: Mar. 15, 2013

(65) Prior Publication Data

US 2014/0123924 A1 May 8, 2014

Related U.S. Application Data

(60) Provisional application No. 61/722,090, filed on Nov. 2, 2012.

(51) Int. Cl.

| | |
|---|---|
| ***F02P 23/00*** | (2006.01) |
| ***F02M 21/00*** | (2006.01) |
| ***F02M 27/00*** | (2006.01) |
| ***F02B 51/00*** | (2006.01) |

(52) U.S. Cl.
USPC ..... 123/143 B; 123/297; 123/538; 123/539; 123/525

(58) Field of Classification Search
USPC ..... 123/297, 536, 538, 143 B, 539, 1 A, 123/198 A, 525, 27 GE
See application file for complete search history.

(56) References Cited

U.S. PATENT DOCUMENTS

| | | | |
|---|---|---|---|
| 1,307,088 | A | 6/1919 | Drummond |
| 1,451,384 | A | 4/1923 | Whyte |
| 2,255,203 | A | 9/1941 | Wiegand |
| 2,864,974 | A | 12/1958 | Beye |
| 3,058,453 | A | 10/1962 | May |
| 3,060,912 | A | 10/1962 | May |
| 3,081,758 | A | 3/1963 | May |

(Continued)

FOREIGN PATENT DOCUMENTS

| | | | |
|---|---|---|---|
| CN | 1411535 | A | 4/2003 |
| DE | 3443022 | A1 | 5/1986 |

(Continued)

OTHER PUBLICATIONS

International Search Report and Written Opinion for Application No. PCT/US2013/068358; Applicant McAlister Technologies, LLC; Date of Mailing: Feb. 12, 2014, 17 pages.

(Continued)

*Primary Examiner* — Hai Huynh
(74) *Attorney, Agent, or Firm* — Perkins Coie LLP

(57) ABSTRACT

Methods, systems, and devices are disclosed for injecting and igniting a fuel using corona discharge for combustion. In one aspect, a method to ignite a fuel in an engine includes injecting ionized fuel particles into a combustion chamber of an engine, and generating one or more corona discharges at a particular location within the combustion chamber to ignite the ionized fuel particles, in which the generating includes applying an electric field at electrodes configured at a port of the combustion chamber, the electric field applied at a frequency that does not produce an ion current or spark on or between the electrodes.

22 Claims, 17 Drawing Sheets

(56) References Cited

U.S. PATENT DOCUMENTS 3,149,620 A 9/1964 Cataldo
3,243,335 A 3/1966 Faile
3,286,164 A 11/1966 De Huff
3,361,161 A 1/1968 Schwartz
3,373,724 A 3/1968 Papst
3,520,961 A 7/1970 Suda et al.
3,551,738 A 12/1970 Young
3,594,877 A 7/1971 Suda et al.
3,608,050 A 9/1971 Carman et al.
3,689,293 A 9/1972 Beall
3,762,170 A 10/1973 Fitzhugh
3,802,194 A 4/1974 Tanasawa et al.
3,926,169 A 12/1975 Leshner et al.
3,931,438 A 1/1976 Beall et al.
3,960,995 A 6/1976 Kourkene
3,976,039 A 8/1976 Henault
3,997,352 A 12/1976 Beall
4,066,046 A 1/1978 McAlister
4,095,580 A 6/1978 Murray et al.
4,099,494 A 7/1978 Goloff et al.
4,105,004 A 8/1978 Asai et al.
4,122,816 A 10/1978 Fitzgerald et al.
4,135,481 A 1/1979 Resler, Jr.
4,183,467 A 1/1980 Sheraton et al.
4,203,393 A 5/1980 Giardini
4,313,412 A 2/1982 Hosaka et al.
4,330,732 A 5/1982 Lowther
4,332,223 A 6/1982 Dalton
4,364,342 A 12/1982 Asik
4,364,363 A 12/1982 Miyagi et al.
4,368,707 A 1/1983 Leshner et al.
4,377,455 A 3/1983 Kadija et al.
4,402,036 A 8/1983 Hensley et al.
4,469,160 A 9/1984 Giamei
4,483,485 A 11/1984 Kamiya et al.
4,511,612 A 4/1985 Huther et al.
4,514,712 A 4/1985 McDougal
4,528,270 A 7/1985 Matsunaga
4,531,679 A 7/1985 Pagdin
4,536,452 A 8/1985 Stempin et al.
4,567,857 A 2/1986 Houseman et al.
4,574,037 A 3/1986 Samejima et al.
4,677,960 A 7/1987 Ward
4,688,538 A 8/1987 Ward et al.
4,716,874 A 1/1988 Hilliard et al.
4,733,646 A 3/1988 Iwasaki
4,736,718 A 4/1988 Linder
4,742,265 A 5/1988 Giachino et al.
4,760,818 A 8/1988 Brooks et al.
4,760,820 A 8/1988 Tozzi
4,774,914 A 10/1988 Ward
4,774,919 A 10/1988 Matsuo et al.
4,830,286 A 5/1989 Asslaender et al.
4,841,925 A 6/1989 Ward
4,922,883 A 5/1990 Iwasaki
4,967,708 A 11/1990 Linder et al.
4,977,873 A 12/1990 Cherry et al.
4,982,708 A 1/1991 Stutzenberger
5,034,852 A 7/1991 Rosenberg
5,035,360 A 7/1991 Green et al.
5,036,669 A 8/1991 Earleson et al.
5,055,435 A 10/1991 Hamanaka et al.
5,056,496 A 10/1991 Morino et al.
5,076,223 A 12/1991 Harden et al.
5,095,742 A 3/1992 James et al.
5,109,817 A 5/1992 Cherry
5,131,376 A 7/1992 Ward et al.
5,134,982 A 8/1992 Hosoi
5,150,682 A 9/1992 Magnet
5,193,515 A 3/1993 Oota et al.
5,207,208 A 5/1993 Ward
5,211,142 A 5/1993 Matthews et al.
5,220,901 A 6/1993 Morita et al.
5,222,481 A 6/1993 Morikawa
5,267,601 A 12/1993 Dwivedi
5,297,518 A 3/1994 Cherry
5,305,360 A 4/1994 Remark et al.
5,328,094 A 7/1994 Goetzke et al.
5,343,699 A 9/1994 McAlister
5,361,737 A * 11/1994 Smith et al. ..... 123/143 B
5,377,633 A 1/1995 Wakeman
5,392,745 A 2/1995 Beck
5,394,852 A 3/1995 McAlister
5,421,299 A 6/1995 Cherry
5,435,286 A 7/1995 Carroll, III et al.
5,439,532 A 8/1995 Fraas
5,456,241 A 10/1995 Ward
5,473,502 A 12/1995 Bonavia et al.
5,475,772 A 12/1995 Hung et al.
5,497,744 A 3/1996 Nagaosa et al.
5,517,961 A 5/1996 Ward
5,531,199 A 7/1996 Bryant et al.
5,534,781 A 7/1996 Lee et al.
5,549,746 A 8/1996 Scott et al.
5,568,801 A 10/1996 Paterson et al.
5,584,490 A 12/1996 Inoue et al.
5,588,299 A 12/1996 DeFreitas
5,598,699 A * 2/1997 Few et al. ..... 60/39.821
5,605,125 A 2/1997 Yaoita
5,607,106 A 3/1997 Bentz et al.
5,649,507 A * 7/1997 Gregoire et al. ..... 123/143 B
5,676,026 A 10/1997 Tsuboi et al.
5,699,253 A 12/1997 Puskorius et al.
5,702,761 A 12/1997 DiChiara, Jr. et al.
5,704,321 A 1/1998 Suckewer et al.
5,714,680 A 2/1998 Taylor et al.
5,715,788 A 2/1998 Tarr et al.
5,738,818 A 4/1998 Atmur et al.
5,745,615 A 4/1998 Atkins et al.
5,746,171 A 5/1998 Yaoita
5,767,026 A 6/1998 Kondoh et al.
5,769,049 A 6/1998 Nytomt et al.
5,797,427 A 8/1998 Buescher
5,806,581 A 9/1998 Haasch et al.
5,832,906 A 11/1998 Douville et al.
5,853,175 A 12/1998 Udagawa
5,863,326 A 1/1999 Nause et al.
5,876,659 A 3/1999 Yasutomi et al.
5,896,842 A 4/1999 Abusamra
5,915,272 A 6/1999 Foley et al.
5,930,420 A 7/1999 Atkins et al.
5,941,207 A 8/1999 Anderson et al.
6,015,065 A 1/2000 McAlister
6,017,390 A 1/2000 Charych et al.
6,026,568 A 2/2000 Atmur et al.
6,029,627 A 2/2000 VanDyne
6,029,640 A 2/2000 Bengtsson et al.
6,062,498 A 5/2000 Klopfer
6,085,990 A 7/2000 Augustin
6,092,501 A 7/2000 Matayoshi et al.
6,092,507 A 7/2000 Bauer et al.
6,093,338 A 7/2000 Tani et al.
6,102,303 A 8/2000 Bright et al.
6,138,639 A 10/2000 Hiraya et al.
6,173,913 B1 1/2001 Shafer et al.
6,185,355 B1 2/2001 Hung
6,189,522 B1 2/2001 Moriya
6,253,728 B1 7/2001 Matayoshi et al.
6,267,307 B1 7/2001 Pontoppidan
6,281,976 B1 8/2001 Taylor et al.
6,335,065 B1 1/2002 Steinlage et al.
6,340,015 B1 1/2002 Benedikt et al.
6,360,721 B1 3/2002 Schuricht et al.
6,360,730 B1 3/2002 Koethe
6,378,485 B2 4/2002 Elliott
6,386,178 B1 5/2002 Rauch
6,443,373 B1 9/2002 Portugues
6,446,597 B1 9/2002 McAlister
6,453,660 B1 9/2002 Johnson et al.
6,455,173 B1 9/2002 Marijnissen et al.
6,478,007 B2 11/2002 Miyashita et al.
6,483,311 B1 11/2002 Ketterer et al.
6,490,391 B1 12/2002 Zhao et al.
6,501,875 B2 12/2002 Zhao et al.

(56) References Cited

U.S. PATENT DOCUMENTS 6,503,584 B1 1/2003 McAlister
6,506,336 B1 1/2003 Beall et al.
6,516,114 B2 2/2003 Zhao et al.
6,517,011 B1 2/2003 Ayanji et al.
6,532,315 B1 3/2003 Hung et al.
6,542,663 B1 4/2003 Zhao et al.
6,543,700 B2 4/2003 Jameson et al.
6,549,713 B1 4/2003 Pi et al.
6,556,746 B1 4/2003 Zhao et al.
6,567,599 B2 5/2003 Hung
6,571,035 B1 5/2003 Pi et al.
6,578,775 B2 6/2003 Hokao
6,583,901 B1 6/2003 Hung
6,584,244 B2 6/2003 Hung
6,587,239 B1 7/2003 Hung
6,599,028 B1 7/2003 Shu et al.
6,615,899 B1 9/2003 Woodward et al.
6,626,164 B2 9/2003 Hitomi et al.
6,663,027 B2 12/2003 Jameson et al.
6,668,630 B1 12/2003 Kuglin et al.
6,672,277 B2 1/2004 Yasuoka et al.
6,700,306 B2 3/2004 Nakamura et al.
6,705,274 B2 3/2004 Kubo
6,722,340 B1 4/2004 Sukegawa et al.
6,725,826 B2 4/2004 Esteghlal
6,745,744 B2 * 6/2004 Suckewer et al. ..... 123/297
6,756,140 B1 6/2004 McAlister
6,763,811 B1 7/2004 Tamol, Sr.
6,772,965 B2 8/2004 Yildirim et al.
6,776,352 B2 8/2004 Jameson
6,786,200 B2 9/2004 Viele et al.
6,832,472 B2 12/2004 Huang et al.
6,832,588 B2 12/2004 Herden et al.
6,841,309 B1 1/2005 Alpay et al.
6,845,920 B2 1/2005 Sato et al.
6,850,069 B2 2/2005 McQueeney et al.
6,851,413 B1 2/2005 Tamol, Sr.
6,854,438 B2 2/2005 Hilger et al.
6,871,630 B2 3/2005 Herden et al.
6,881,386 B2 4/2005 Rabinovich et al.
6,883,490 B2 4/2005 Jayne
6,883,507 B2 * 4/2005 Freen ..... 123/606
6,899,076 B2 5/2005 Funaki et al.
6,904,893 B2 6/2005 Hotta et al.
6,912,998 B1 7/2005 Rauznitz et al.
6,925,983 B2 8/2005 Herden et al.
6,940,213 B1 9/2005 Heinz et al.
6,954,074 B2 10/2005 Zhu et al.
6,976,683 B2 12/2005 Eckert et al.
6,978,767 B2 12/2005 Bonutti
6,984,305 B2 1/2006 McAlister
6,993,960 B2 2/2006 Benson
6,994,073 B2 2/2006 Tozzi et al.
7,007,658 B1 3/2006 Cherry et al.
7,013,863 B2 3/2006 Shiraishi et al.
7,025,358 B2 4/2006 Ueta et al.
7,032,845 B2 4/2006 Dantes et al.
7,070,126 B2 7/2006 Shinogle
7,073,480 B2 7/2006 Shiraishi et al.
7,086,376 B2 8/2006 McKay
7,104,246 B1 9/2006 Gagliano et al.
7,104,250 B1 9/2006 Yi et al.
7,121,253 B2 10/2006 Shiraishi et al.
7,124,964 B2 10/2006 Bui
7,131,426 B2 11/2006 Ichinose et al.
7,137,382 B2 11/2006 Zhu et al.
7,138,046 B2 11/2006 Roychowdhury
7,140,347 B2 11/2006 Suzuki et al.
7,198,208 B2 4/2007 Dye et al.
7,204,133 B2 4/2007 Benson et al.
7,249,578 B2 7/2007 Fricke et al.
7,255,290 B2 8/2007 Bright et al.
7,272,487 B2 9/2007 Christen et al.
7,278,392 B2 10/2007 Zillmer et al.
7,284,543 B2 10/2007 Kato et al.
7,302,792 B2 12/2007 Land, III et al.
7,308,889 B2 12/2007 Post et al.
7,340,118 B2 3/2008 Wlodarczyk et al.
7,367,319 B2 5/2008 Kuo et al.
7,386,982 B2 6/2008 Runkle et al.
7,395,146 B2 7/2008 Ueda et al.
7,404,395 B2 7/2008 Yoshimoto
7,418,940 B1 9/2008 Yi et al.
7,449,034 B1 11/2008 Mikkelsen et al.
7,481,043 B2 1/2009 Hirata et al.
7,484,369 B2 2/2009 Myhre
7,554,250 B2 6/2009 Kadotani et al.
7,625,531 B1 12/2009 Coates et al.
7,626,315 B2 12/2009 Nagase
7,627,416 B2 12/2009 Batenburg et al.
7,628,137 B1 12/2009 McAlister
7,628,145 B2 12/2009 Ishibashi et al.
7,650,873 B2 1/2010 Hofbauer et al.
7,690,352 B2 4/2010 Zhu et al.
7,703,775 B2 4/2010 Matsushita et al.
7,707,832 B2 5/2010 Commaret et al.
7,714,483 B2 5/2010 Hess et al.
7,721,697 B2 * 5/2010 Smith et al. ..... 123/143 B
7,728,489 B2 6/2010 Heinz et al.
7,849,833 B2 12/2010 Toyoda
7,900,850 B2 3/2011 Zengerle et al.
7,918,212 B2 4/2011 Verdejo et al.
8,069,836 B2 12/2011 Ehresman
8,091,536 B2 1/2012 Munshi et al.
8,104,444 B2 1/2012 Schultz
8,132,560 B2 3/2012 Ulrey et al.
8,147,599 B2 4/2012 McAlister
8,192,852 B2 6/2012 McAlister
8,240,293 B2 8/2012 Ikeda
8,267,063 B2 9/2012 McAlister
8,297,254 B2 * 10/2012 McAlister ..... 123/297
8,312,759 B2 11/2012 McAlister
8,318,131 B2 11/2012 McAlister
8,365,700 B2 * 2/2013 McAlister ..... 123/297
8,371,273 B2 2/2013 Ulrey et al.
8,387,599 B2 * 3/2013 McAlister ..... 123/675
8,416,552 B2 * 4/2013 Gefter et al. ..... 361/213
8,441,361 B2 5/2013 McAlister
8,469,009 B2 6/2013 Munshi et al.
8,511,259 B2 8/2013 Ambrosini et al.
8,538,663 B2 9/2013 Jung et al.
8,578,902 B2 11/2013 Permuy et al.
8,601,819 B2 12/2013 Hammer et al.
8,646,432 B1 * 2/2014 McAlister et al. ..... 123/297
2002/0017573 A1 2/2002 Sturman
2002/0070287 A1 6/2002 Jameson et al.
2002/0084793 A1 7/2002 Hung et al.
2002/0131171 A1 9/2002 Hung
2002/0131666 A1 9/2002 Hung et al.
2002/0131673 A1 9/2002 Hung
2002/0131674 A1 9/2002 Hung
2002/0131706 A1 9/2002 Hung
2002/0131756 A1 9/2002 Hung
2002/0141692 A1 10/2002 Hung
2002/0150375 A1 10/2002 Hung et al.
2002/0151113 A1 10/2002 Hung et al.
2003/0012985 A1 1/2003 McAlister
2004/0008989 A1 1/2004 Hung
2004/0084017 A1 5/2004 Viele et al.
2004/0084026 A1 5/2004 Zhu et al.
2004/0187847 A1 9/2004 Viele et al.
2005/0126537 A1 6/2005 Daniels et al.
2005/0255011 A1 11/2005 Greathouse et al.
2005/0257776 A1 11/2005 Bonutti
2006/0016916 A1 1/2006 Petrone et al.
2006/0169244 A1 8/2006 Allen
2007/0186903 A1 8/2007 Zhu et al.
2007/0189114 A1 8/2007 Reiner et al.
2008/0017170 A1 1/2008 Moroi et al.
2009/0093951 A1 4/2009 McKay et al.
2009/0101114 A1 4/2009 Czekala et al.
2011/0146619 A1 * 6/2011 McAlister ..... 123/297
2012/0112620 A1 5/2012 Lykowski et al.
2012/0180743 A1 7/2012 Burrows et al.

(56) References Cited

U.S. PATENT DOCUMENTS

| | | | |
|---|---|---|---|
| 2012/0199088 | A1 | 8/2012 | Burrows et al. |
| 2012/0210968 | A1 | 8/2012 | Burrows et al. |
| 2013/0149621 | A1 | 6/2013 | McAlister |

FOREIGN PATENT DOCUMENTS

| | | | |
|---|---|---|---|
| DE | 19731329 | C1 | 6/1998 |
| DE | 10356133 | A1 | 7/2005 |
| DE | 102006021192 | A1 | 11/2007 |
| EP | 671555 | A1 | 9/1995 |
| GB | 1038490 | A | 8/1966 |
| JP | 02-259268 | A | 10/1990 |
| JP | 08-049623 | A | 2/1996 |
| JP | 2004-324613 | A | 11/2004 |
| JP | 2009-287549 | A | 12/2009 |

OTHER PUBLICATIONS

U.S. Appl. No. 13/797,351, McAlister.
U.S. Appl. No. 13/843,976, McAlister.
U.S. Appl. No. 13/844,240, McAlister.
"Ford DIS/EDIS "Waste Spark" Ignition System." Accessed: Jul. 15, 2010. Printed: Jun. 8, 2011. <http://rockledge.home.comcast.net/~rockledge/RangerPictureGallery/DIS_EDIS.htm>. pp. 1-6.
"P dV's Custom Data Acquisition Systems Capabilities." PdV Consulting. Accessed: Jun. 28, 2010. Printed: May 16, 2011. <http://www.pdvconsult.com/capabilities%20-%20daqsys.html>. pp. 1-10.
"Piston motion equations." Wikipedia, the Free Encyclopedia. Published: Jul. 4, 2010. Accessed: Aug. 7, 2010. Printed: Aug. 7, 2010. <http://en.wikipedia.org/wiki/Dopant>. pp. 1-9.
"Piston Velocity and Acceleration." EPI, Inc. Accessed: Jun. 28, 2010. Printed: May 16, 2011. <http://www.epi-eng.com/piston_engine_technology/piston_velocity_and_acceleration.htm>. pp. 1-3.
"SmartPlugs—Aviation." SmartPlugs.com. Published: Sep. 2000. Accessed: May 31, 2011. <http://www.smartplugs.com/news/aeronews0900.htm>. pp. 1-3.
Birchenough, Arthur G. "A Sustained-arc Ignition System for Internal Combustion Engines." Nasa Technical Memorandum (NASA TM-73833). Lewis Research Center. Nov. 1977. pp. 1-15.
Britt, Robert Roy. "Powerful Solar Storm Could Shut Down U.S. For Months—Science News | Science & Technology | Technology News—FOXNews.com." FoxNews.com, Published: Jan. 9, 2009. Accessed: May 17, 2011. <http://www.foxnews.com/story/0,2933,478024,00.html>. pp. 1-2.
Brooks, Michael. "Space Storm Alert: 90 Seconds from Catastrophe." NewScientist. Mar. 23, 2009. pp. 1-7.
Doggett, William. "Measuring Internal Combustion Engine In-Cylinder Pressure with LabVIEW." National Instruments. Accessed: Jun. 28, 2010. Printed: May 16, 2011. <http://sine.ni.com/cs/app/doc/p/id/cs-217>. pp. 1-2.
Erjavec, Jack. "Automotive Technology: a Systems Approach, vol. 2." Thomson Delmar Learning. Clifton Park, NY. 2005. p. 845.
Hodgin, Rick. "NASA Studies Solar Flare Dangers to Earth-based Technology." TG Daily. Published: Jan. 6, 2009. Accessed: May 17, 2011. <http://www.tgdaily.com/trendwatch/40830-nasa-studies-solar-flare-dangers-to-earth-based-technology>. pp. 1-2.
Hollembeak, Barry. "Automotive Fuels & Emissions." Thomson Delmar Learning. Clifton Park, NY. 2005. p. 298.
InfraTec GmbH. "Evaluation Kit for FPI Detectors | Datasheet—Detector Accessory." 2009. pp. 1-2.
Lewis Research Center. "Fabry-Perot Fiber-Optic Temperature Sensor." NASA Tech Briefs. Published: Jan. 1, 2009. Accessed: May 16, 2011. <http://www.techbriefs.com/content/view/2114/32/>.
Pall Corporation, Pall Industrial Hydraulics. Increase Power Output and Reduce Fugitive Emissions by Upgrading Hydrogen Seal Oil System Filtration. 2000. pp. 1-4.
Riza et al. "All-Silicon Carbide Hybrid Wireless-Wired Optics Temperature Sensor Network Basic Design Engineering for Power Plant Gas Turbines." International Journal of Optomechatronics, vol. 4, Issue 1. Jan. 2010. pp. 1-9.
Riza et al. "Hybrid Wireless-Wired Optical Sensor for Extreme Temperature Measurement in Next Generation Energy Efficient Gas Turbines." Journal of Engineering for Gas Turbines and Power, vol. 132, Issue 5. May 2010. pp. 051601-1-51601-11.
Salib et al. "Role of Parallel Reformable Bonds in the Self-Healing of Cross-Linked Nanogel Particles." Langmuir, vol. 27, Issue 7. 2011. pp. 3991-4003.
International Search Report and Written Opinion for Application No. PCT/US2009/067044; Applicant: McAlister Technologies, LLC.; Date of Mailing: Apr. 14, 2010 (11 pages).
International Search Report and Written Opinion for Application No. PCT/US2010/002080; Applicant: McAlister Technologies, LLC.; Date of Mailing: Jul. 7, 2011 (8 pages).
International Search Report and Written Opinion for Application No. PCT/US2011/024778 Applicant: McAlister Technologies, LLC.; Date of Mailing: Sep. 27, 2011 (10 pages).
International Search Report and Written Opinion for Application No. PCT/US2010/054364; Applicant: McAlister Technologies, LLC.; Date of Mailing: Aug. 22, 2011, 8 pages.
Supplementary European Search Report for Application No. EP 10846264.9; Applicant McAlister Technologies, LLC.; Date of Mailin Oct. 2, 2013, 5 pages.

* cited by examiner

FUEL INJECTION SYSTEMS WITH ENHANCED CORONA BURST

CROSS-REFERENCE TO RELATED APPLICATION(S)

This patent document claims the priority of U.S. provisional application No. 61/722,090 entitled "FUEL INJECTION AND COMBUSTION SYSTEM FOR HEAT ENGINES" filed on Nov. 2, 2012, the entire disclosure of the application 61/722,090 is incorporated herein by reference for all purposes.

TECHNICAL FIELD

This patent document relates to injector technologies.

BACKGROUND

Fuel injection systems are typically used to inject a fuel spray into an inlet manifold or a combustion chamber of an engine. Fuel injection systems have become the primary fuel delivery system used in automotive engines, having almost completely replaced carburetors since the late 1980s. Fuel injectors used in these fuel injection systems are generally capable of two basic functions. First, they deliver a metered amount of fuel for each inlet stroke of the engine so that a suitable air-fuel ratio can be maintained for the fuel combustion. Second, they disperse fuel to improve the efficiency of the combustion process. Conventional fuel injection systems are typically connected to a pressurized fuel supply, and the fuel can be metered into the combustion chamber by varying the time for which the injectors are open. The fuel can also be dispersed into the combustion chamber by forcing the fuel through a small orifice in the injectors.

Diesel fuel is a petrochemical derived from crude oil. It is used to power a wide variety of vehicles and operations. Compared to gasoline, diesel fuel has a higher energy density (e.g., 1 gallon of diesel fuel contains ~$155\times10^6$ J, while 1 gallon of gasoline contains ~$132\times10^6$ J). For example, most diesel engines are capable of being more fuel efficient as a result of direct injection of the fuel to produce stratified charge combustion into unthrottled air that has been sufficiently compression heated to provide for the ignition of diesel fuel droplets, as compared to gasoline engines, which are operated with throttled air and homogeneous charge combustion to accommodate such spark plug ignition-related limitations. However, while diesel fuel emits less carbon monoxide than gasoline, it emits nitrogen-based emissions and small particulates that can produce global warming, smog, and acid rain along with serious health problems such as emphysema, cancer, and cardiovascular diseases.

SUMMARY

Techniques, systems, and devices are disclosed for injecting and igniting a fuel using corona discharge for combustion.

In one aspect of the disclosed technology, a method to ignite a fuel in an engine includes injecting ionized fuel particles into a combustion chamber of an engine, and generating one or more corona discharges at a particular location within the combustion chamber to ignite the ionized fuel particles, the generating including applying an electric field at electrodes configured at a port of the combustion chamber, the electric field applied at a frequency that does not produce an ion current or spark on or between the electrodes.

In another aspect, a method to combust a fuel in an engine includes injecting ionized oxidant particles into a combustion chamber of an engine, the combustion chamber having a fuel present, and generating one or more corona discharges at a particular location within the combustion chamber to ignite the ionized oxidant particles, the generating including applying an electric field at electrodes configured at a port of the combustion chamber, the electric field applied at a frequency that does not produce an ion current or spark on or between the electrodes, in which the ignited ionized oxidant particles initiate a combustion process with the fuel.

In another aspect, a method to combust a fuel in an engine includes injecting inert gas particles into a combustion chamber of an engine, the combustion chamber having a fuel and oxidant present, and generating one or more corona discharges at a particular location within the combustion chamber to ignite the inert gas particles, the generating including applying an electric field at electrodes configured at a port of the combustion chamber, the electric field applied at a frequency that does not produce an ion current or spark on or between the electrodes, in which the one or more corona discharges initiate a combustion process with the fuel and the oxidant in the combustion chamber.

The subject matter described in this patent document can be implemented in specific ways that provide one or more of the following exemplary features. In some examples, one or more rapid (e.g., nanosecond) corona discharges can be established in patterns based on the thrusted ions that penetrate the combustion chamber by the Lorentz acceleration and/or pressure gradients. For example, the corona discharge can be produced by applying an electric potential on an antenna electrode interfaced with the combustion chamber, in which the corona discharge takes a form of the striated pattern, and in which the corona discharge ignites the ionized fuel and/or oxidant particles within the combustion chamber. The disclosed technology can include the following operational characteristics and features for releasing heat by combustion of fuel within a gaseous oxidant substance in a combustion chamber. For example, stratified heat generation can be achieved where a gaseous oxidant in a combustion chamber completely oxidizes one or more additions of stratified fuel, and where surplus oxidant substantially insulates the combustion products from the combustion chamber surfaces. For example, the conversion of heat produced by stratified products of combustion into work can be achieved by expanding such products and/or by expanding surrounding inventory of the insulating oxidant. The beginning of combustion can be accelerated before, at, or after top dead center (ATDC) to enable substantial combustion to increase combustion chamber pressure, e.g., before crankshaft rotation through 90° ATDC and completion of combustion before 120° ATDC.

The disclosed technology can enhance compression-ignition in existing conventional diesel engines by producing faster stratified multi-burst deliveries of alternative fuels (e.g., such as hydrogen and methane) that expedite beginning and completion of combustion. For example, methane fuel can be utilized and injected into the engine using a Lorentz thrust of ionized fuel (e.g., ionized methane particles) and/or ionized oxidants at controlled velocities. For example, the velocities can be in a range from Mach 0.2 to Mach 10. For example, stratified charged fuel can be ignited by using a corona discharge to the ion patterns established by the Lorentz multi-bursts. For example, the disclosed technology enables the control of the velocity of thrusted ions (e.g., ionized fuel particles and/or ionized oxidant particles) into the combustion chamber, as well as the population of ions in the plasma that is thrust into the combustion chamber. Additionally, the disclosed technology can control the direction of vectors in the launch/thrust pattern, along with the included angle. Such control of the thrust velocity, the ion population of the formed plasma, and the direction/angle of the ion thrust can be achieved by controlling particular parameters including one or more of applied voltage, current delivered, magnetic lens, fuel pressure into an injector, and/or combustion chamber pressure.

BRIEF DESCRIPTION OF THE DRAWINGS

Like reference symbols and designations in the various drawings indicate like elements.

DETAILED DESCRIPTION

Figure 1A:
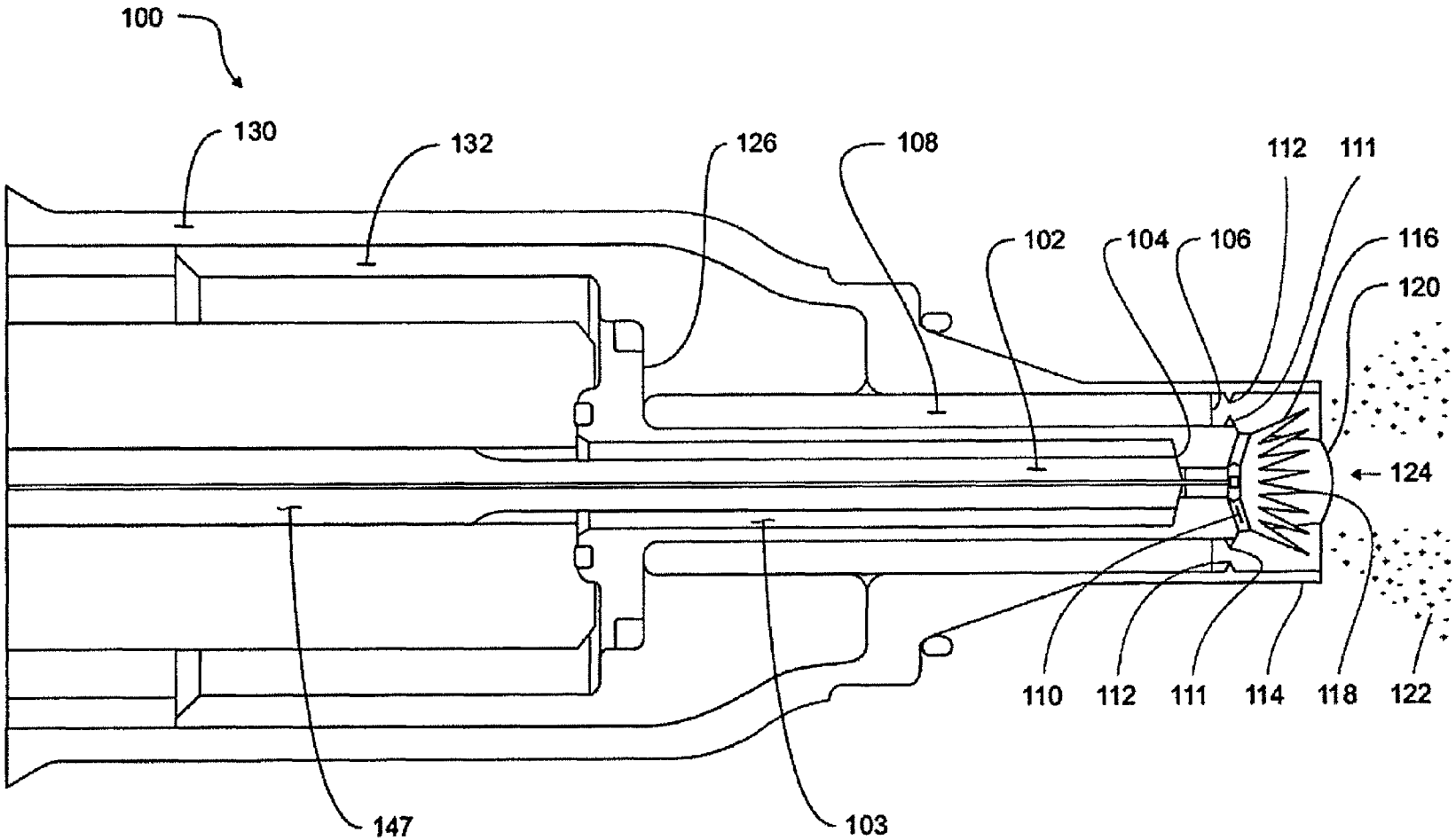
FIG. 1A shows a schematic of an exemplary embodiment of a fuel injection and ignition system.

A corona discharge is an electrical discharge by which a current flows into a fluid medium (e.g., such as air) from an electrically energized conductor material, e.g., such as from a protruding structure or point of the conductor, by the ionization of the fluid surrounding a conductor, which can form a plasma. A corona can occur if the field strength of an electric field emanating from the conductor exceeds the breakdown field strength of the fluid medium. Yet, the electric field strength is not large enough to cause electrical breakdown or arcing to nearby matter. During discharge, the formed ions ultimately pass charge to neighboring regions having lower potential or recombine to form neutral molecules. In some examples, the corona discharge can occur if a high voltage is applied to the conductor with protrusions, depending on other parameters including the geometric conditions surrounding the conductor, e.g., like distance to an electrical ground-like source. In other examples, the corona discharge can occur if a protrusion structure of an electrically grounded conductor (e.g., at zero voltage) is brought near a charged object with a high field strength to exceed the breakdown field strength of the medium. For example, in air, this can be seen as a bluish (or other color) glow in the air adjacent to pointed metal conductors carrying high voltages.

In a combustion chamber of an engine, a corona discharge can be produced by the application of a large voltage to a central electrode that causes the surrounding gas to become locally ionized due to the nonuniform electric field gradient that exists based on the orientation of the central electrode within geometry of the chamber, forming a conductive envelope. The conductive boundary is determined by the electric field intensity and represents the corona formed in the chamber, in which the field intensity decreases with greater distance away from the central electrode. The generated corona can exhibit luminous charge flows. However, while the boundary may be controlled, conventional methods cannot control the placement or burst pattern of the corona discharge.

Techniques, systems, and devices are disclosed for injecting and igniting a fuel using corona discharges for combustion.

In one aspect, a method to ignite a fuel in an engine includes injecting ionized fuel particles into a combustion chamber of an engine, and generating one or more corona discharges at a particular location within the combustion chamber to ignite the ionized fuel particles, in which the generating includes applying an electric field at electrodes configured at a port of the combustion chamber, the electric field applied at a frequency that does not produce an ion current or spark on or between the electrodes.

For example, by implementation of the method, the one or more corona discharge(s) can initiate a combustion process of the ionized fuel particles with oxidant compounds present in the combustion chamber. The one or more corona discharge (s) can be generated at controllable distances within the combustion chamber. For example, the particular location of the corona discharge(s) can be at a distance from the port in the combustion chamber based on the striated pattern of the accelerated ionized fuel particles. In some implementations, for example, the corona discharge(s) can be generated at controllable durations, e.g., including fast, nanosecond range durations.

In some implementations, the method to inject the ionized fuel particles can include distributing a fuel between electrodes of an integrated fuel injector and ignition device interfaced at the port of the combustion chamber of the engine, generating an ion current of ionized fuel particles by applying an electric field between the electrodes to ionize at least some of the fuel, and producing a Lorentz force to accelerate the ionized fuel particles into the combustion chamber. For example, the Lorentz force can be utilized to accelerate/thrust the ionized fuel particles into the combustion chamber in a striated pattern. Additionally or alternatively to the generating the corona discharge, for example, the method can include utilizing the Lorentz-thrusted ionized fuel particles to initiate and/or accelerate combustion with an oxidant presented in the combustion chamber. For example, the fuel can include, but is not limited to, methane, natural gas, an alcohol fuel including at least one of methanol or ethanol, butane, propane, gasoline, diesel fuel, ammonia, urea, nitrogen, and hydrogen.

In some implementations, the method can also include distributing an oxidant between the electrodes of the device, and ionizing at least some of the oxidant using an electric field to form ionized oxidant particles, and producing a Lorentz force to accelerate the ionized oxidant particles into the combustion chamber. For example, the Lorentz force can be utilized to accelerate/thrust the ionized fuel particles into the combustion chamber in a striated pattern. Additionally or alternatively to the generating the corona discharge, for example, the method can include utilizing the Lorentz-thrusted ionized oxidant particles to initiate and/or accelerate combustion with the ionized fuel particles in the combustion chamber, or fuel present in the combustion chamber. For example, the oxidant (oxidant compounds) can include, but is not limited to, oxygen gas ($O_2$), ozone ($O_3$), oxygen atoms (O), hydroxide ($OH^-$), carbon monoxide (CO), and nitrous oxygen ($NO_x$). In some implementations, air can be used to provide the oxidant.

For example, in some implementations, the ionized oxidant particles are produced to be the same charge compared to the ionized fuel particles. In other implementations, the ionized oxidant particles are produced to be oppositely charged to the ionized fuel particles. For example, in some implementations, the velocities of the ionized fuel particles (or the directly-injected fuel) are configured to be sufficiently larger than the oxidant particles to assure initiation of oxidation and combustion of such fuel particles.

In another aspect, a method to combust a fuel in an engine includes injecting ionized oxidant particles into a combustion chamber of an engine, in which the combustion chamber has a fuel present, and generating one or more corona discharges at a particular location within the combustion chamber to ignite the ionized oxidant particles, in which the generating includes applying an electric field at electrodes configured at a port of the combustion chamber, the electric field applied at a frequency that does not produce an ion current or spark on or between the electrodes, in which the ignited ionized oxidant particles initiate a combustion process with the fuel. In some implementations of the method, for example, the ionized oxidant particles can be injected by producing a Lorentz force. For example, the Lorentz force can accelerate the ionized oxidant particles into the chamber in a striated pattern, such that the particular location of the generated one or more corona discharges includes a distance from the port in the combustion chamber based on the striated pattern of the accelerated ionized oxidant particles.

In another aspect, a method to combust a fuel in an engine includes injecting inert gas particles into a combustion chamber of an engine, in which the combustion chamber has a fuel present, and generating one or more corona discharges at a particular location within the combustion chamber to ignite the inert gas particles, in which the generating includes applying an electric field at electrodes configured at a port of the combustion chamber, the electric field applied at a frequency that does not produce an ion current or spark on or between the electrodes, in which the one or more corona discharges initiate a combustion process with the fuel and the oxidant in the combustion chamber. For example, the inert gas particles can include, but is not limited to, argon, xenon, neon, or helium.

In some implementations, the disclosed systems, devices, and methods can be implemented to enhance compression-ignition of diesel fuel by operating an engine with faster stratified multi-burst deliveries of alternative fuels (e.g., such as hydrogen and methane) and to expedite the beginning and completion of combustion. In some implementations, the faster stratified multi-burst delivery of fuels used for expedited beginning and completion of combustion can be implemented with methane fuel by Lorentz thrusting of ionized fuel (e.g., ionized methane and/or particles derived from methane or from products of methane reactions) and/or ionized oxidants at controlled velocities (e.g., which can range from Mach 0.2 to Mach 10) and accelerated combustion of the stratified charged fuel using corona discharge to the ion patterns established by the one or more Lorentz thrusts (multi-bursts). The velocity of the thrusted ions (e.g., ionized fuel particles and/or ionized oxidant particles) into the combustion chamber can be controlled, as well as the population of ions in the plasma that is thrust into the combustion chamber. Additionally, the disclosed techniques, systems, and devices can control the direction of vectors in the launch/thrust pattern, along with the included angle. Such control of the thrust velocity, the ion population of the formed plasma, and the direction/angle of the ion thrust can be achieved by controlling particular parameters including one or more of applied voltage, current delivered, magnetic lens, fuel pressure into an injector, and/or combustion chamber pressure.

For example, the initial gap in the high compression pressure gas can be controlled to be quite small, e.g., to limit the wear-down of electrode(s) (of an exemplary injector) and be no more than a conventional spark plug at low compression. Also for example, the number of such gaps can be 100 or more, instead of a single gap, to further extend the application life. In some examples, after the initial current is accomplished, it is thrust away from the small gap(s), then the current can be suddenly enlarged to many thousand peak amps by capacitor discharge. Spark-free corona discharge can then be timed to overtake and be patterned by the Mach 1-10 ions.

The disclosed system, devices, and techniques for Lorentz thrust of ions can include thrusting of one or both of the oxidant ions and fuel ions, which can provide an accelerated initiation and completion of combustion. For example, presenting a stratified charge of oxidant ions into the combustion chamber utilizing a Lorentz thrust with subsequent injection of oppositely charged fuel ions (e.g., using Lorentz thrust) can achieve the fastest combustion, but yet, Lorentz thrust of just one of the oxidant ions or fuel ions still accelerates the combustion process. Further enhancement of combustion can be achieved by multi-burst injections of each of the oxidant ions and fuel ions as a function of valve opening and/or Lorentz thrusts at an adaptively adjusted controlled frequency.

The disclosed system, devices, and techniques for corona discharge to produce ignition can be implemented by applying of an electric field potential at a rate or frequency that is too fast for ionization or ion current or "spark" on or between the electrodes. For example, fuel ignition by implementation of the disclosed systems and methods for creating corona discharge bursts can provide benefits including preserving the life of electrodes, e.g., because the electrodes do not experience substantial wear or loss of materials due to non-sparking.

Systems are described that can be utilized to implement the disclosed method.

FIG. 1A shows a cross-sectional view of a schematic showing at least some of the components of a system 100 combining fuel injection and ignition systems. The system 100 includes a containment case 130 to provide structural support for at least some of the components of the system 100. In some exemplary embodiments, the containment case 130 can be configured of an insulative material. In some implementations of the system 100, pressurized fuel is routed to an inward opening flow control valve 102 that is retracted from stationary valve seat 104 by a valve actuator to provide fuel flow from coaxial accumulator and passageway 103 through conduit 106 to one or more intersecting ports 110. The valve actuator of the system 100 that actuates the valve 102 may include by any suitable system, e.g., including hydraulic, pneumatic, magnetostrictive, piezoelectric, magnetic or electromagnetic types of operations. For example, an exemplary valve actuator may be connected and acted on by a push-pull coaxial piezoelectric actuator in an annular space or an appropriately connected electromagnetic winding in the space that acts on a disk armature to open and close the valve 102 by force applied through valve stem 147.

The system 100 includes a multi-electrode coaxial electrode subsystem including electrodes 114, 126, and 116 to ionize oxidants, e.g., provided by air, as well as provide the Lorentz thrust of such ionized fuel and/or oxidant particles. As shown in FIG. 1A, the electrode 114 includes an outside diameter configured to fit within a port to combustion chamber 124, e.g., such as a port ordinarily provided for a diesel fuel injector in a diesel engine. In some implementations, the electrode 114 can be structured as a tubular or cylindrical electrode, e.g., which can be configured to have a thin-walled structure and interfacing with the port to the combustion chamber 124. For example, the electrode 114 can be configured with the electrode 126 as a coaxial electrode, in which an inner tubular or cylindrical electrode structure 126 is surrounded in an outer tubular or cylindrical shell electrode structure 114. The coaxial electrode 114 and 126 can be structured to include ridges or points 112 and/or 111, respectively. The exemplary ridge or point features 111 and/or 112 of the coaxial electrode can concentrate an applied electrical field and reduce the gap for initial production of an initial ion current, e.g., which can occur at a considerably reduced voltage, as compared to ordinary spark plug gap requirements in high compression engines. Additionally, for example, the ridges or points 111 and/or 112 allow the electrode 114 to be substantially supported and/or shielded and protected by the surrounding material of the engine port through which the system 100 operates. The electrode 116 is configured within the annular region of the coaxial structure 114 and interfaces with the port to the combustion chamber 124. In some implementations, for example, the electrode 116 is structured to include electrode antenna 118 at the distal end (interfaced with the port of the combustion chamber 124).

The system includes an insulator and capacitor structure 132 that surrounds at least a portion of a coaxial insulator tube 108 that can be retained in place by axial constraint provided by the ridges or points 111 and/or 112 as shown, and/or other ridges or points not shown in the cross-sectional view of the schematic of FIG. 1A. For example, engine cooling systems including air and liquid cooling systems provide for the material surrounding electrode 114 to be a beneficial heat sink to prevent overheating of electrode 114 or the voltage containment tube 108.

The system 100 can include one or more permanent magnets (not shown in FIG. 1A) on the annular passageway of the valve to produce a magnetic field that when utilized with the applied electric field produces Lorentz acceleration on the ionized particles. In some implementations, for example, the magnetic field can be operated to produce a Lorentz current having a torsional moment. For example, following such initiation, the ion current is rapidly increased in response to rapidly reduced resistance, and the growing ion current is accelerated toward the combustion chamber 124 by Lorentz force.

The disclosed Lorentz thrust techniques can produce any included angle of entry pattern of ionized fuel and/or oxidants into the combustion chamber. For example, in an idling engine, the thrusted particles can be controlled to enter at a relatively small entry angle, whereas in an engine operating at full power, the thrusted particles can be controlled to enter with a relatively large angle and at higher velocity for greatest penetration into the combustion chamber (e.g., the widest included angles provide for greater air utilization to generate greater power in combustion). For example, the system 100 can enable utilization of excess air in the combustion chamber 124 to insulate the stratified charge combustion of fuel and utilize heat in production of expansive work produced by combustion gases, e.g., before heat can be lost to piston, cylinder, or head, etc.

In one example, Lorentz thrusting fuel and/or oxidant particles can be produced by applying of a sufficient electric field strength to initially produce a conductive ion current across a relatively small gap between electrode features, e.g., such as the electrode ridges or points 111 and/or 112. The ion current can be utilized to produce a Lorentz force on the ions of the ion current to thrust/accelerate the ions toward the combustion chamber 124, as shown by the representative spray of ionized particles (ions) 122 in FIG. 1A. The relatively small ion current initiated across the smaller gap between the exemplary electrodes ridges or points 111 and 112 (e.g., as compared to a subsequently larger ion current across the electrodes 116 and 114) first reduces the resistance to establishing a larger ion current, in which the larger ion current can be used to generate an even larger Lorentz force on the particles.

The described Lorentz thrust technique provides control over the produced Lorentz force. For example, the Lorentz force can be increased by controlling the electric field strength to grow the population of ions in the produced ion current. Also, for example, the Lorentz force can be increased by increasing the availability of particles to be ionized to produce the ion current, e.g., by increasing the amount of distributed air and/or fuel in the spacing between the electrodes. Also, for example, the exemplary Lorentz thrust technique can be implemented to ionize a smaller ion population to form the initial ion current, in which the smaller population of ionized particles can be used to thrust other particles (e.g., including nonionized particles) within the overall population of particles.

In other examples, a magnetic field can be generated and controlled, e.g., by a magnet of the system 100 (not shown in FIG. 1A), in which the magnetic field interacts with the produced ion current to generate the Lorentz force on the ions of the ion current to thrust/accelerate the ions 122 toward the combustion chamber 124. In other examples, a Lorentz force can be produced by the disclosed systems, devices, and methods distinct from producing an ion current, in which the applied electric field between the electrodes (e.g., such as the electrodes 111 and 112) can be controlled to ionize the oxidant and/or fuel particles while not producing a current, and a magnetic field can be generated and controlled, e.g., by a permanent or electromagnet of the system 100, for example, at the general location zone, to interact with the ionized particles in the electric field to produce a Lorentz force to accelerate/thrust and shape the pattern of the ionized particles 122 toward the combustion chamber 124.

Application of such Lorentz thrust of ion currents may be implemented during the intake and/or compression periods of engine operation to produce a stratified charge of activated oxidant particles, e.g., such as electrons, $O_3$, O, $OH^-$, CO, and $NO_x$ from constituents ordinarily present in air that is introduced from the combustion chamber, e.g., such as $N_2$, $O_2$, $H_2O$, and $CO_2$. Fuel may be introduced before, at, or after the piston reaches top dead center (TDC) to start the power stroke following one or more openings of the valve 102. For example, fuel particles can be first accelerated by pressure drop from annular passageway 103 to the annular passageway between the coaxial electrode structure 114 and the electrode 116. The electrodes 116 and 114 ionize the fuel particles, e.g., with the same or opposite charge as the oxidant ions, to produce a current across the coaxial electrode 114 and electrode 116. Lorentz acceleration may be controlled to launch the fuel ions and other particles that are swept along to be thrust into the combustion chamber 124 at sufficient velocities to overtake or intersect the previously launched oxidant ions. For example, in instances where the fuel ions are the same charge as the oxidant ions (and are thus accelerated away from such like charges), the swept fuel particles that are not charged are ignited by the ionized oxidant particles and the ionized fuel particles penetrate deeper into compressed oxidant to be ignited and thus complete the combustion process.

In some implementations, a Lorentz (thrust pattern)-induced corona discharge may be applied to further expedite the completion of combustion processes. Corona ionization and radiation can be produced from the electrode antenna 118 in an induced pattern presented by the Lorentz-thrusted ions 122 into the combustion chamber 124 (as shown in FIG. 1A). Corona discharge may be produced by applying an electrical field potential at a rate or frequency that is too rapid to allow ion current or "spark" to occur between the electrode ridges or points 111 and/or 112 or the electrode 114 and the antenna 118. Illustratively, for example, one or more corona discharges, which may be produced by the rapidly applied fields (e.g., in time spans ranging from a few nanoseconds to several tens of nanoseconds), are adequate to further expedite the completion of combustion processes, e.g., depending upon the combustion chamber pressure and chemical constituents present in such locations. Protection of the antenna 118 from oxidation or other degradation may be provided by a ceramic cap 120. For example, suitable materials for the ceramic cap 120 include, but are not limited to, quartz, sapphire, multicrystalline alumina, and stoichiometric or non-stoichiometric spinel. The ceramic cap 120 may also be provided to protect pressure and temperature sensor instrumentation fibers or filaments that extend through the valve 102, in which some of the fibers or filaments extend to the surface of the ceramic cap 120 and/or to electromagnets or permanent magnets that can be contained or included by the electrode antenna 118. For example, sapphire instrumentation filaments can be used as the pressure and/or temperature sensor instrumentation fibers or filaments to extend into or through the ceramic cap 120, e.g., such as spinel, to measure the temperature and/or pressure and/or fuel injection and combustion pattern to determine the air utilization efficiency and brake mean effective pressure for adaptive optimization of one or more adjustable controls, e.g., such adaptive controls to control operations such as the fuel pressure, operation of the valve 102, Lorentz thrusting timing and magnitude, and corona discharge timing and frequency.

Figure 1B:
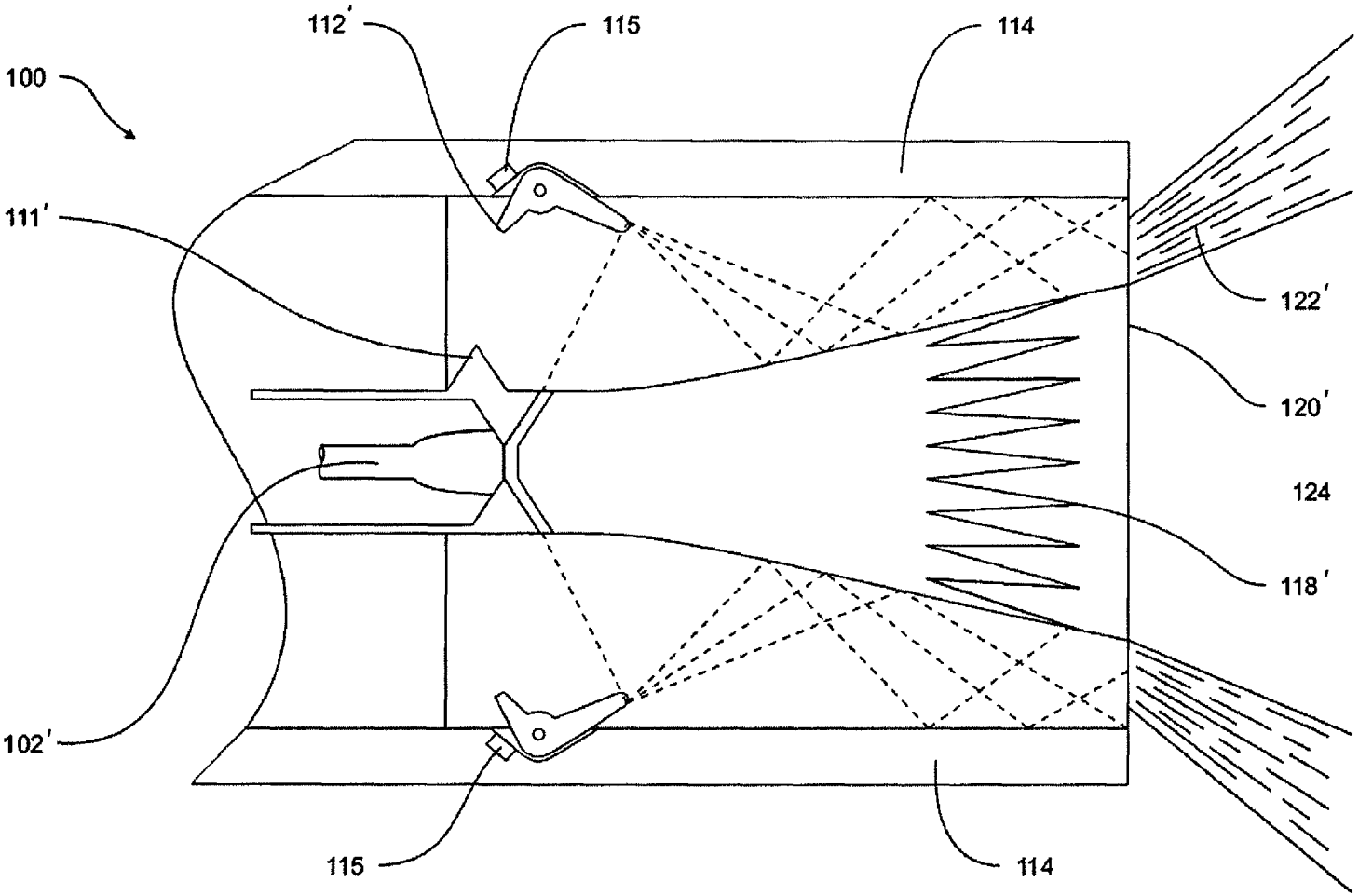
FIG. 1B shows a schematic of another exemplary embodiment of the system of FIG. 1A to provide a variable electrode gap.

FIG. 1B shows a portion of an alternate embodiment of the system 100 showing components that provide a variable electrode gap between articulated points or tips 112' and 111'. For example, in operation, the tips 112' can initiate a Lorentz ion current in a smaller gap to reduce the energy required to produce the ion current and reduce the resistance to establishing a larger current. At a selected time, e.g., such as just before the ion current is established, fuel valve 102' can be actuated to open to allow one or more bursts of fuel to impinge and rotate valve tip toward tip 111' to reduce the gap and provide for the initiation of a conductive ion current with greatly reduced energy, e.g., as compared to developing an arc current in a considerably larger spark plug gap that is adequate for lean burn air/fuel ratios. For example, after the initial ion current is established, a magnet 115 embedded in the wall of the electrode 114 and or in the base of tip 112' can rotate the tip 112' away from tip 111'. For example, such electrode gaps can be configured to be at their smallest to initiate Lorentz ion current and/or configured to be at their widest to facilitate and improve the efficiency of one or more corona discharges into the Lorentz ion thrust pattern 122' in the combustion chamber 124, e.g., in which the corona discharges initiated by electrode antenna 118' (e.g., which may have a protective ceramic shield 120').

Figure 2:
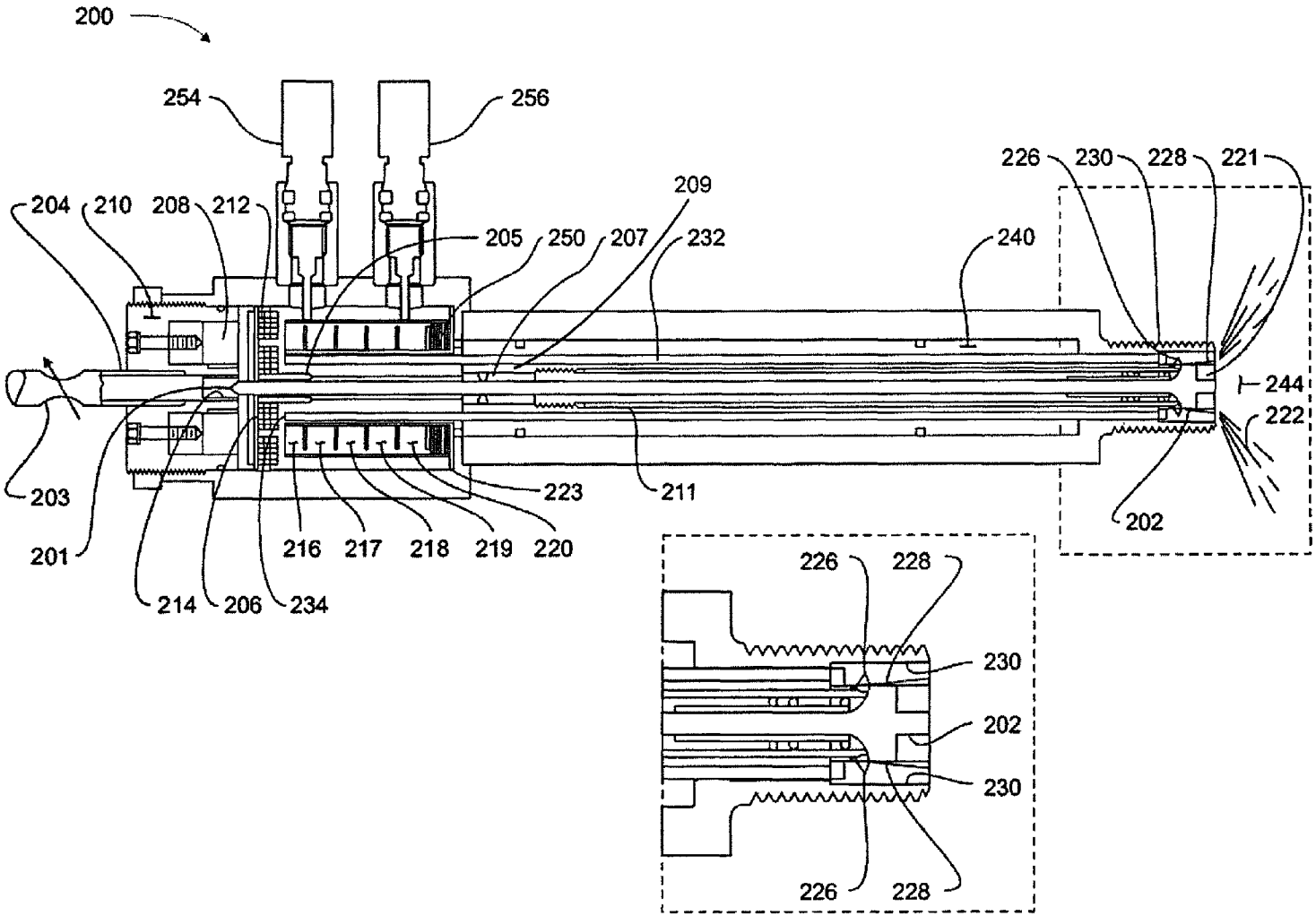
FIG. 2 shows a schematic of another exemplary embodiment of a fuel injection and ignition system.

FIG. 2 shows a cross-sectional view of a schematic of an embodiment of a fuel injection and ignition system 200. The system 200 may be operated on low voltage electricity, e.g., which can be delivered by cable 254 and/or cable 256, e.g., in which such low voltage is used to produce higher voltage by actuating an exemplary electromagnet assembly to open a fuel valve and to produce Lorentz thrust and/or corona ignition events. The system 200 includes an outwardly opening fuel control valve 202 that allows intermittent fuel to flow from a pressurized supply into the system 200 through conduit fitting 204. The system 200 includes a valve actuator for actuation of the fuel control valve 202, which may include any suitable system, e.g., including, but not limited to, hydraulic, pneumatic, magnetostrictive, piezoelectric, magnetic or electromagnetic types of operations. As an illustrative example of combined magnetic and electromagnetic control, the fuel control valve 202 is held closed by force exerted on disk armature 206 by an electromagnet and/or permanent magnet 208 in a coaxial zone of retaining cap component 210. Disk armature 206 is guided in the bore of component 210 by tubular skirt 214 within which fuel introduced through pressure trim regulator 203 and tube conduit 204 passes to axial passageways or holes 205 through the disk 206 surrounding the valve stem and retainer 201 of the fuel control valve 202. Fuel flow continues through passageways 207 into accumulator volume 209 and serves as a coolant, dielectric fluid, and/or heat sink for an insulator tube 232 (e.g., such as a dielectric voltage containment tube) within the system 200.

For example, in certain applications such as small-displacement high-speed engines, maintaining the insulator tube 232 at a working temperature within an upper limit of about 50° C. above the ambient temperature of the fuel or other fluid supplied through passageway 204 is an important function of the fluids flowing through annular accumulator 209 which may be formed as a gap and/or one or more linear or spiral passageways in the outside surface of electrode tube 211. Such heat transfer enhancement to fluid moving through the accumulator 209 and to such fluids as expansion cooling occurs upon the opening of valve 202 from the valve seat provided by conductive tube 211 enables the insulator tube 232 to be made of materials that would have compromised the dielectric strength if allowed to reach higher operating temperatures.

Illustratively, the insulator tube 232 may be made of a selection of material disclosed in U.S. Pat. No. 8,192,852, which is incorporated by reference in its entirety as part of the disclosure in this patent document, that is thinner-walled because of the fluid cooling embodiment of the insulator tube 232 may be made of coaxial or spiral wound layers of thin-wall selections of the materials listed in Table 1 or as disclosed regarding FIG. 3 of U.S. Pat. No. 8,192,852. In one example, a particularly rugged embodiment provides fiber optic communicator filaments (e.g., communicators 332 of FIG. 3 in U.S. Pat. No. 8,192,852), e.g., made of polymer, glass, quartz, sapphire, aluminum fluoride, ZBLAN fluoride, within spiral or coaxial layers of polyimide or other film material selected from Table 1 of U.S. Pat. No. 8,192,852. Another exemplary embodiment of the insulator tube 232 can include a composite tube material including a glass, quartz, or sapphire tube that may be combined with one or more outside and/or inside layers of polyimide, parylene, polyether sulfone, and/or PTFE.

As exemplified by the illustrative embodiment shown in FIG. 2, actuation for opening of the fuel control valve 202 occurs when the armature 206 is operated to overcome the magnetic force exerted by an electromagnet and/or a permanent magnet. The armature 206 is configured between an electromagnet 212 and a permanent magnet in annular zone 208. The electromagnet 212 is structured to include one or more relatively flat electromagnetic solenoid windings (e.g., coaxial windings of insulated magnetic wire). The permanent magnet 208 is configured to provide permanent polarity to the armature component 206. In some examples, the armature 206 includes two or more pieces, in which a first piece is configured on the side of the armature 206 that is interfaced with the permanent magnet 208 and the second piece is configured as the other side of the armature 206 that interfaces with the electromagnet 212. The first armature piece, which is biased towards the permanent magnet having undergone saturation, attracts the second armature component to rest against it thereby setting the armature 206 in a 'cocked' position. Activation of the electromagnet 212 can then pull the closest armature component towards the electromagnet 212 to accelerate and gain kinetic energy that is suddenly transferred to the other component to quickly open the valve 202 (e.g., to allow fuel to flow). Upon relaxation of electromagnet 212 the armature assembly 206 returns to the 'cocked' position. Each fuel burst actuated into the system 200 can be projected into the combustion chamber 224 in one or more sub-bursts of accelerated fuel particles by the disclosed techniques of Lorentz thrusting.

In the exemplary embodiment, the fuel injection and ignition system 200 includes a series of inductor windings, exemplified as inductor windings 216-220 in annular cells in this exemplary embodiment, as shown in FIG. 2. In some implementations, the series of inductor windings 216-220 can be utilized as a secondary inline transformer to produce attractive force on armature 206 in the opening actuation of the valve 202. For example, the pulsing of coils of the electromagnet 212 builds current and voltage in secondary of the transformer annular cells 216-220. Thus, less energy (e.g., current in the coils of the electromagnet 212) is required to pull the armature 206 to the right and open the valve. In some implementations, an electromagnetic field is produced when voltage is applied to at least one inductor winding of the series of inductor windings 216-220. For example, the electromagnetic field is amplified as it progresses through the winding coils from a first cell (e.g., inductor winding 216) where a first voltage is applied to subsequent winding coils in the series. In some examples, additional voltage can be applied at subsequent winding cells in the series of inductor windings 216-220, e.g., in which the additional voltages are applied using additional leads interfaced at the desired winding cells. Also for example, the transformer can make its own high voltage to remove RF interference.

In some implementations, the magnet 208 can be configured as an electromagnet. In such examples, activation of the electromagnet 212 may be aided by applying the energy discharged as the field of the exemplary electromagnet 208 collapses. Alternatively, for example, in certain duty cycles, the discharge of the exemplary electromagnet 208 in the a coaxial zone space and/or the electromagnet 212 may be utilized with or without additional components (e.g., such as other inductors or capacitors) to rapidly induce current in windings of a suitable transformer 216, which may be successively wound in annular cells such as 217, 218, 219, and 220. Examples of such are disclosed in U.S. Pat. No. 4,514,712, which is incorporated by reference in its entirety as part of the disclosure in this patent document. For example, this discharge of the exemplary electromagnet 208 in the a coaxial zone space and/or the electromagnet 212 can reduce the stress on magnet wire windings as sufficiently higher voltage is produced by each annular cell to initiate Lorentz thrusting of ions initiated by reduced gap between electrode features 226 of electrode 228 and electrode 230, as shown in the insert schematic of FIG. 2.

The insulator tube 232 can be configured as a coaxial tube that insulates and provides voltage containment of voltage generated by the transformer assembly's inductor windings 216, 217, . . . 220. For example, insulator tube 232 is axially retained by electrode ridges on the inside diameter of electrode 230 and/or points 226 of electrode 228. In some embodiments, the insulator tube 232 is transparent to enable sensors 234 to monitor piston speed and position, pressure, and radiation frequencies produced by combustion events in combustion chamber 224 beyond electrode 228 and/or 230. For example, such speed-of-light instrumentation data enables each combustion chamber to be adaptively optimized regarding oxidant ionizing events, timing of one or more fuel injection bursts, timing of one or more Lorentz sub-bursts, and timing of one or more corona discharge events, along with fuel pressure adjustments.

Application of such Lorentz thrust may be implemented during the intake and/or compression period of engine operation to produce a stratified charge of activated oxidant particles, e.g., such as electrons, $O_3$, O, $OH^-$, CO, and NO from constituents ordinarily present in air, e.g., such as $N_2$, $O_2$, $H_2O$, and $CO_2$. Fuel may be introduced before, at, or after the piston reaches top dead center following one or more openings of fuel control valve 202. Fuel may be ionized to produce a current across coaxial electrodes 226 and 230, and the Lorentz acceleration may be controlled to launch fuel ions and other particles that are thrust into combustion zone 224 at sufficient velocities to overtake the previously launched oxidant ions.

For example, such ionized particles can include ionized oxidant particles that are utilized to initiate combustion of fuel, e.g., fuel that is dispersed into such ionized oxidant particles. In another example, fuel introduced upon opening of the valve 202 flows between coaxial electrodes 230 and 228. Fuel particles are ionized by the electric field, and the ionized fuel particles are accelerated into the combustion chamber by the Lorentz force to initiate and/or accelerate combustion. In other examples, the ionized oxidant particles are produced with the same or opposite charge compared to the ionized fuel particles. In other examples, the velocities of the fuel particles and/or ionized fuel particles can be controlled to be sufficiently larger than the oxidant particles to assure initiation of oxidation and combustion of such fuel particles.

In some implementations of the system 200, a Lorentz thrust pattern-induced corona discharge may be applied to further expedite the completion of combustion processes. Shaping the penetration pattern of oxidant and/or fuel ions may be achieved by various combinations of electromagnet or permanent magnets in annular space 221, or by helical channels or fins on the inside diameter of the electrode 230 or the outside diameter of the electrode 228 as shown. Corona ionization and radiation can be produced from electrode antenna, e.g., such as at the combustion chamber end of electrode 228, which may be provided by discharge of one or more capacitors such as 223 and/or 240 contained within the system 200 in the induced pattern presented by ions 222 that are produced and thrust into combustion chamber zone 224. Corona discharge may be produced by applying an electrical field potential at a rate or frequency that is too rapid to allow ion current or spark to occur between electrode 230 and antenna, e.g., which in some implementations can be included on the electrode 228.

The fuel injection and ignition system 200 can include a controller 250 that receives combustion chamber instrumentation data and provides adaptive timing of events selected from options, e.g., such as (1) ionization of oxidant during compression in the reduced gap between electrodes 226 and 230; (2) adjustment of Lorentz force as a function of the current and oxidant ion population generated by continued application of EMF between the electrodes; (3) opening of the fuel control valve 202 and controlling duration that fuel flow occurs; (4) ionization of fuel particles before, at, or after TDC during power stroke in the reduced gap between electrodes 226 and 230; (5) adjustment of Lorentz force as a function of the current and fuel ion population generated by continued application of EMF between the electrodes; (6) adjustment of the time after completion of fuel flow past insulator 232 to provide a corona nanosecond field from the electrode antenna (e.g., antenna 228) and with controlled frequency of the corona field application; and (7) subsequent production and injection of fuel ions followed by corona discharge after one or more adaptively determined intervals "$t_v$" to provide multi bursts of stratified charge combustion.

One exemplary implementation of the fuel injection and ignition system 200 to produce an oxidant ion current and subsequent ion current of fuel particles to thrust into a combustion chamber and/or initiate combustion is described. A voltage can be applied to create current in stator coils of the electromagnet 212. For example, the conductor applies a voltage, e.g., 12 V or 24 V, to create the current in the electromagnet coils 212. The current can create a voltage in the secondary inline transformer, in which the series of inductor windings 216-220 in annular cells are used to step up voltage.

The pulsing of the electromagnet coils 212 builds voltage in the transformer (e.g., inductor windings wound 216-220 in the annular cells). In some implementations, initiation of Lorentz thrust can be produced by approximately 30 kV or less across the electrode 226, which can be achieved on highest compression, e.g., accomplishing combustion with a low gap and plasma. For example, this represents the highest boost diesel retrofit known and achieves efficient stratified charge combustion in unthrottled air at idle, acceleration, cruise, and full power fuel rates, along with great reduction or elimination of objectionable emissions. In contrast, for example, in regular spark plug technology about 80 kV is needed for combustion of homogeneous charge mixtures of fuel with throttled air, which is coupled with compromised results, e.g., including emissions of oxides of nitrogen and reduced power production and fuel economy.

For example, based on the applied voltage, the conductor tube 211 is energized to produce an ion current between electrode tips 226 (of the electrode 228) and the electrode 230, e.g., the ion current formed of oxidant ion particles ionized from air. For example, air can enter the space between annular electrodes 228 and 230 of the system 200 from the combustion chamber 224 during exhaust, intake, or compression cycles, or in other examples, air can be brought into the system 200 through the valve 202 or through input tubes, which can be coupled with the cables 254 and/or 256. For example, the ionized oxidant particles can be thrusted into the combustion chamber 224 of the engine before top dead center (TDC) to deliver energized ions in that space (e.g., pre-conditioning and ionizing the oxidant) to provide faster ignition and completion of combustion of fuel that is subsequently injected. This can achieve effects such as reduction of time to initiate combustion and of time to complete combustion.

For example, to thrust the ionized oxidant particles, the energized conductor tube 211 delivers oxidant ion current between electrode tips 226 (of the electrode 228) and the electrode 230. The ion current produces a Lorentz acceleration on the ionized oxidant particles that thrust them into combustion chamber 224, e.g., which can be produced as a pattern of Lorentz thrust oxidant ions by the system 200 by control of any of several parameters, e.g., including controlling the DC voltage application profile or the pulsed frequency of the applied electric field between the electrodes.

The fuel control valve 202 can be opened by actuation of the valve actuation unit, and the conductor tube 211 can again be energized to produce an ion current of fuel ion particles, e.g., in which the energized conductor tube 211 provides the ionized fuel particle current between the electrode tips 226 (of the electrode 228) and the electrode 230, thereby producing a pattern of Lorentz thrust fuel ions by the system 200. For example, the valve actuator can cause the movement of the armature 206 to the right. Additionally, for example, fluid in the accumulator volume 209 can help open the fuel control valve 202, e.g., pressurized fluid is delivered through the conduit fitting/passageway 204.

The Lorentz thrust of the fuel ions can initiate combustion as they contact the oxidant ions and/or oxidant in the combustion chamber 224. For example, the fuel ions are thrust out at a higher velocity to overtake the activated oxidant. Subsequently, a highly efficient corona discharge can be repeatedly applied to produce additional combustion activation in the pattern of Lorentz thrust fuel ions. For example, the repetition of the corona discharge can be performed at high frequency, e.g., in the MHz range, to a Lorentz-thrusted ion pattern that exceeds the speed of sound. The corona shape can be determined by the pattern of the oxidant and/or fuel ions. For example, the corona can be shaped by the pattern produced by Lorentz thrusting, as well as by pressure drop and/or swirl of fuel with or without ionization (e.g., due to fins or channels, as shown later in FIG. 8), and combinations of Lorentz thrusting, pressure drop, and swirl.

For example, the one or more corona discharges are initiated to provide additional activations in the pattern of Lorentz thrust fuel ions. For example, one or more additional multi-bursts of fuel can be initiated in the same or new patterns of Lorentz-thrusted ions. For example, an adjustment in included angles can be made by changing the current applied and/or the magnet field applied, e.g., which can allow for the system 200 to meet any combustion chamber configuration for maximum air utilization efficiency.

Additionally, for example, a stratified heat production within surplus oxidant can be implemented using the system 200 by one or more additional fuel bursts followed by corona discharges to provide additional activations in the pattern of Lorentz thrust fuel ions, e.g., which provides more nucleating sites of accelerated combustion. For example, the system 200 can control nanosecond events so the next burst doesn't have to wait until the next cycle.

Figure 3A:
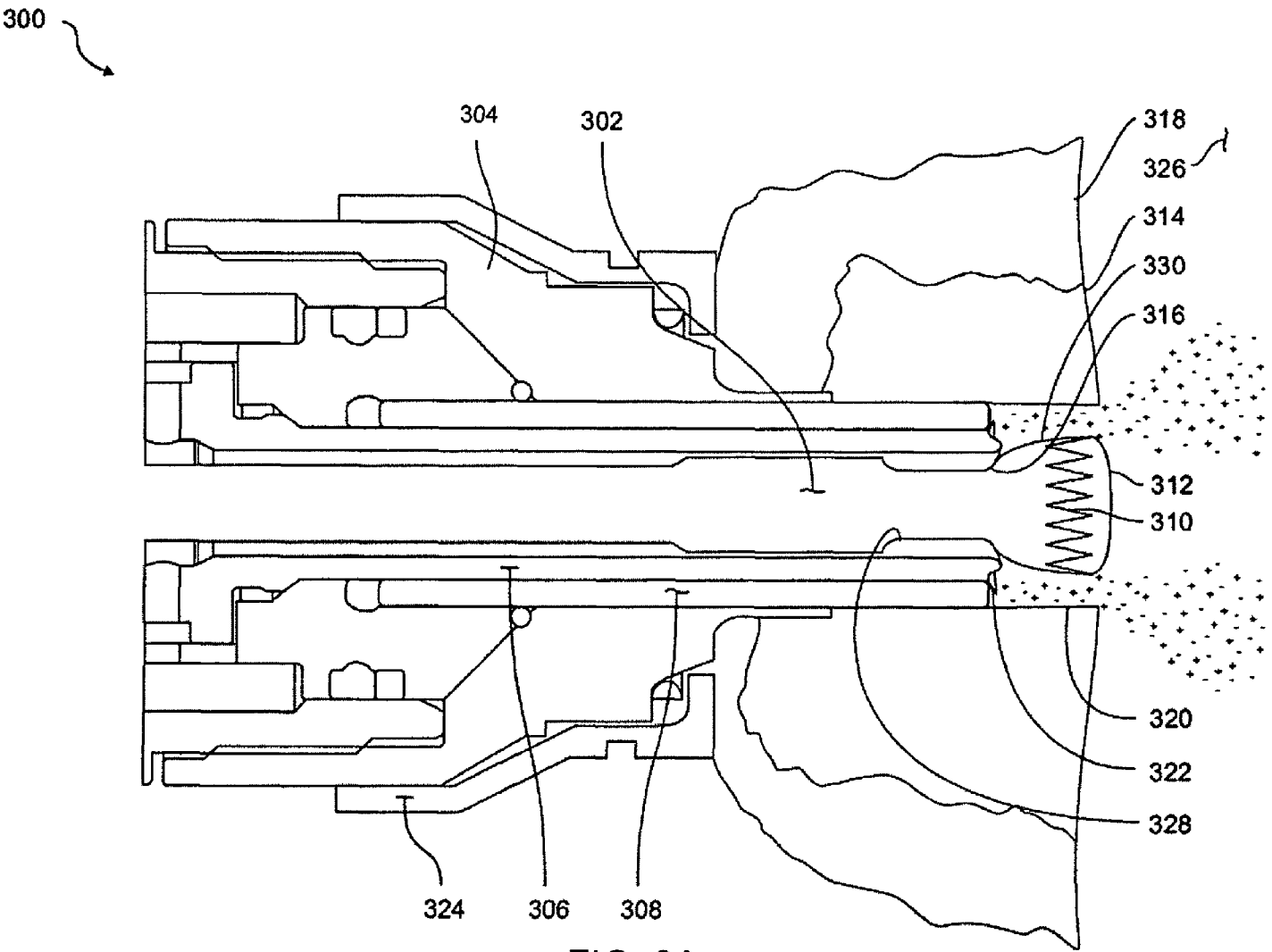
FIG. 3A shows a schematic of another exemplary embodiment of a fuel injection and ignition system.

FIG. 3A shows a cross-sectional view of a schematic of an embodiment of a fuel injection and ignition system 300 that also shows a partial cutaway and section of supporting material 314 of an engine head 318 portion of combustion chamber 326. The exemplary embodiment of the system 300 is shown within changeable tip case assembly 304 for combining fuel injection and ignition systems. The system 300 provides an outward opening fuel control valve 302 that operates in a normally closed position against valve seat 316 of multifunctional tubular fuel delivery electrode 306. Upon actuation, valve 302 opens toward combustion chamber 326 and fuel flows from internal accumulator volume 328 having suitable connecting passageways within the assembly 304. Fuel flow accelerates past the valve seat 316 to enter the annular space between electrode 320 and the annular portion 330 of valve 302.

Figure 3B:
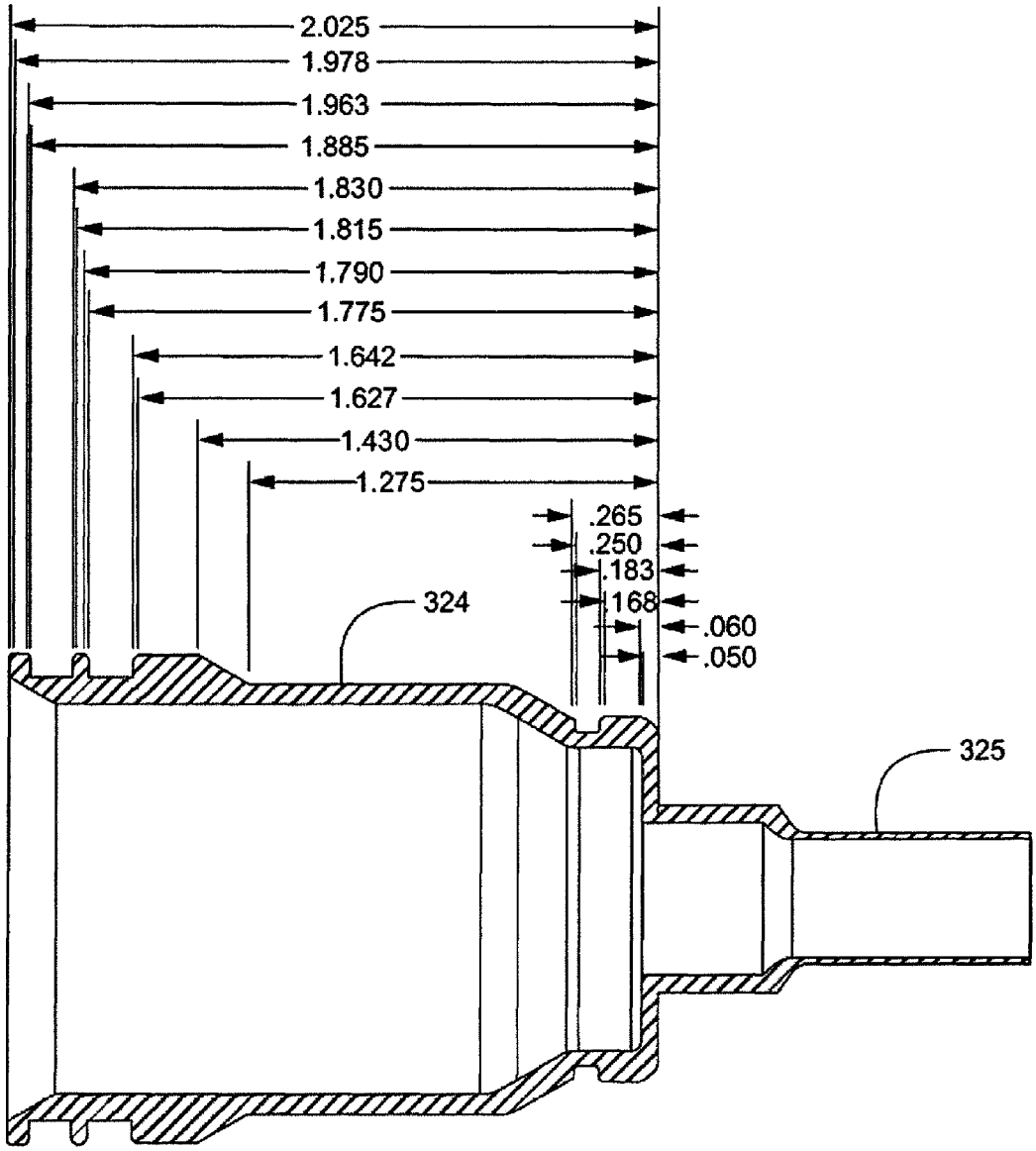
FIG. 3B shows a schematic of an exemplary electrode configuration.

In some examples, the electrode 320 may be a suitable thin walled tubular extension of the tip case 304. Or for example, as shown in FIG. 3B, the electrode 320 may be a tubular portion 325 of a separate insert cup 324 that extends as a liner within the combustion chamber port. In other exemplary applications, the electrode 320 may be the surface of the engine port into combustion chamber 326, as shown in FIG. 3A. In this exemplary embodiment, which is suitable for many engine applications, the electrode 320 can be configured as a relatively thin walled tubular electrode that extends from the assembly body 304 and is readily deformed by an installation tool and/or by combustion gases to conform and rest against the port into combustion chamber 326 of the engine as shown.

In some implementations, plastically reforming tubular electrode 320 to be intimately conformed to the surface of the surrounding port provides solid mechanical support strength for improved fatigue endurance service and greatly improves heat transfer to the engine head and cooling system of the engine to regulate the temperature for improved performance of and life of electrode sleeve 320. For example, this enables electrode sleeve 320 to be made of aluminum, copper, iron, nickel, or cobalt alloys to provide excellent heat transfer and resist or eliminate electrode degradation due to overheating or spark erosion. Suitable coatings for opposing surfaces of electrodes 330 and/or 320 include, for example, unalloyed aluminum and a selection from the alloy family AlCrTiNi, in which the Al constituent is aluminum, the Cr constituent is chromium, the Ti constituent can be titanium, yttrium, zirconium, hafnium or a combination of such metals, and the Ni constituent can be nickel, iron, cobalt or a combination of such metals. For example, the outer diameter surface of electrode sleeve 320 may be coated with aluminum, copper, AlCrTiNi, and/or silver to improve the corrosion resistance and geometrical conformance achieved in service for providing greater fatigue endurance and enhanced heat transfer performance to supporting material 314.

Features 322, such as an increased diameter and/or ridges or spikes, of the delivery electrode tube 306 provide mechanical retention of voltage containment insulator 308. The exemplary features 322 present the first path to the electrode 320 for the production of an ion current in response to application of an ignition voltage from a suitable electrical or electronic driver and control signal by a controller (not shown in the figure, but present in the various embodiments of the fuel injection and ignition system). Examples of such drivers and controller are disclosed in U.S. patent application entitled "CHEMICAL FUEL CONDITIONING AND ACTIVATION", and U.S. patent application entitled "ROTATIONAL SENSOR AND CONTROLLER", both filed on or before Mar. 15, 2013, and both of which the are incorporated by reference in their entirety as part of the disclosure in this patent document. Examples of such suitable drivers and controller are also disclosed in U.S. Pat. Nos. 5,473,502 and 4,122,816 and U.S. patent application publication reference US2010/0282198, each of which the entire document is incorporated by reference as part of the disclosure in this patent document.

For example, upon production of an ion current, the impedance suddenly drops and the current can be greatly amplified if desired in response to controlled application of much lower applied voltage. Growing current established between electrodes 330 and 320 is thrust toward combustion chamber 326 by Lorentz force that is a function of the current magnitude and the field strength of the applied voltage. Ion currents thus developed can be accelerated to achieve launch velocities that are tailored by control of the voltage applied by the electronic driver via the control signal provided by the controller and by control of the pressure of the fluid in the annular space between electrodes the 320 and 330 to optimize oxidant utilization efficiency during idle, acceleration, cruise and full power operations.

Illustratively, current developed by the described ionization of an oxidant, e.g., such as air, that enters the annular space between the electrodes 320 and 330 during intake and/or compression periods of operation can produce an ion pattern that is stratified within surplus oxidant in combustion chamber 326. Subsequently, fuel that enters the annular space between electrodes 320 and 330 can achieve a velocity that is substantially increased by the described Lorentz ion current thrust in addition to the pressure induced flow into the combustion chamber 326. Thus, Lorentz thrust fuel ions and other particles that are swept into the combustion chamber 326 can achieve subsonic or supersonic velocities to overtake oxidant ions, e.g., such as ozone and/or oxides of nitrogen, to greatly accelerate the beginning and/or completion of combustion events, e.g., including elimination of such oxidant ions.

In some implementations, additional impetus to accelerated initiation and/or completion of combustion may be provided by subsequent application of an electrical field at a rate or frequency that is too rapid for ions to traverse the gap between electrodes 320 and 330 to produce corona discharge beyond field shaping antenna, such as antenna 310, which for example may include one or more permanent magnets and/or temperature and pressure sensors that are protected by a suitable ceramic coating 312. Such corona discharge impetus is produced by highly efficient energy conversion that is shaped to occur in the pattern of ions traversing the combustion chamber to thus further extend the advantage of Lorentz-thrusted ions to initiate combustion and/or accelerate the completion of combustion for additional improvement of the electrical ignition efficiency, e.g., as compared to the limitations of spark plug operation.

Figure 3C:
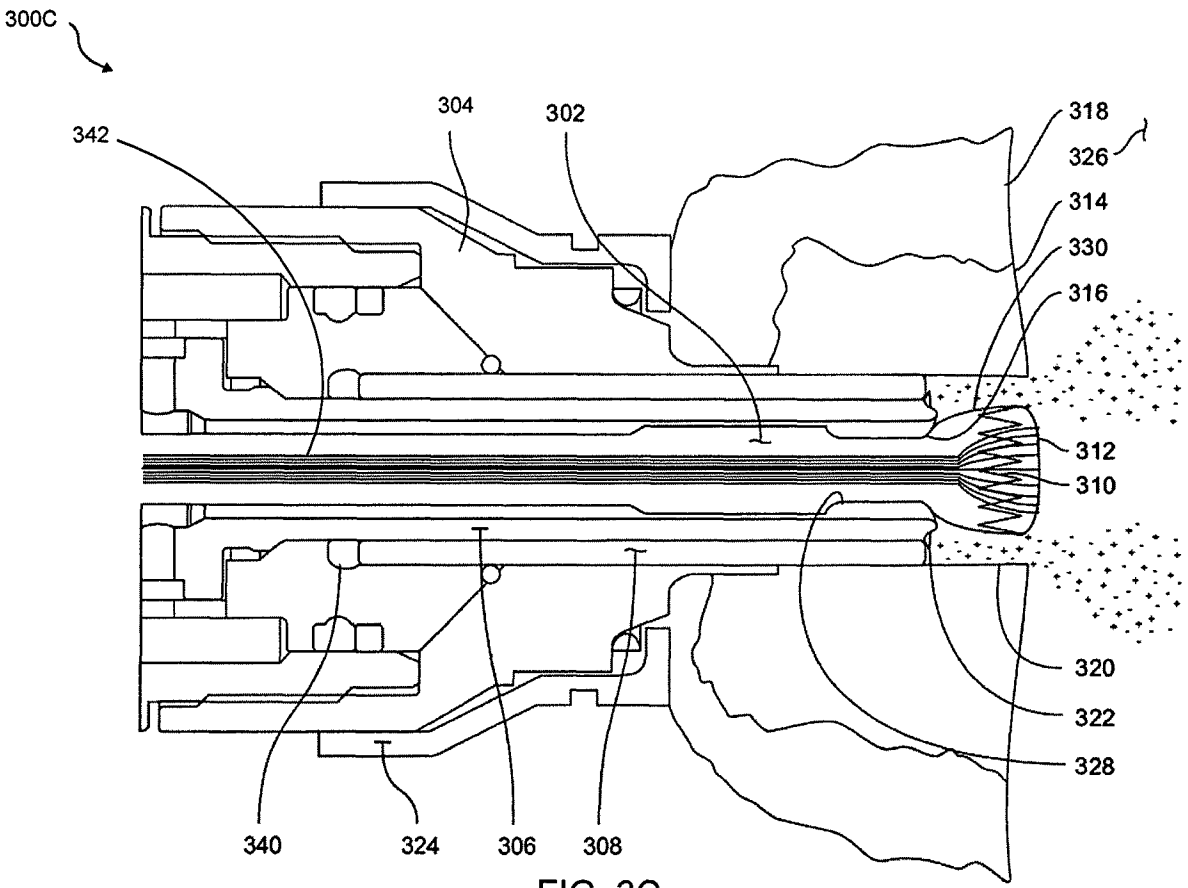
FIG. 3C shows a schematic of another exemplary embodiment of a fuel injection and ignition system.

FIG. 3C shows another embodiment of a fuel injection and ignition system 300C that reverses certain roles of components in the embodiment of the system 300, i.e., the fuel control valve 302 and the delivery electrode tube 306. The system 300C in FIG. 3C includes a solid or tubular electrode 302 that contains and protects various instrumentation 342, e.g., which can include Fabry-Perot fibers and/or IR tubes and/or fiber optics, such as may be selected to monitor combustion chamber pressure, temperature, combustion patterns, and piston positions and acceleration. In some implementations, the tubular electrode 302 can be configured as a stationary component. They system 300C includes a fuel control valve tube 306 that can be retracted by a suitable actuator, e.g., such as a solenoid, magnetostrictive or piezoelectric component, to provide occasional fuel flow past the valve seat 316. In such instances, component 340 may be a suitable mechanical spring or O-ring that urges the return of tube assembly 306 including insulator tube 308 to the normally closed position.

The various embodiments of the fuel injection and ignition systems can include a controller (e.g., like that of the controller 250 shown in FIG. 2) that receives combustion chamber instrumentation data and provides adaptive timing of events selected from options, e.g., such as: (1) ionization of oxidant during compression in reduced gap between electrode 320 and 322; (2) adjustment of Lorentz force as a function of the current and oxidant ion population, e.g., generated by continued application of EMF between electrodes 320 and 330 as shown in FIG. 3A or 3C; (3) opening of the fuel control valve (e.g., fuel control valve 102 as shown in FIG. 1A, fuel control valve 202 as shown in FIG. 2, fuel control valve 302 as shown in FIG. 3A, and fuel control valve 306 as shown in FIG. 3C) and controlling duration that fuel flow occurs; (4) ionization of fuel particles before, at, or after TDC during power stroke in reduced gap between electrode 320 and 322, for example, as shown in FIG. 3A or 3C; (5) adjustment of Lorentz force as a function of the current and fuel ion population generated by continued application of EMF between electrodes 320 and 330, for example, as shown in FIG. 3A or 3C; (6) adjustment of the time after completion of fuel flow past insulator 312 to provide a corona nanosecond field from antenna (e.g., antenna 310) and with controlled frequency of the corona field application; and (7) subsequent production and injection of fuel ions followed by corona discharge after one or more adaptively determined intervals "$t_v$" to provide multi bursts of stratified charge combustion.

Figure 4:
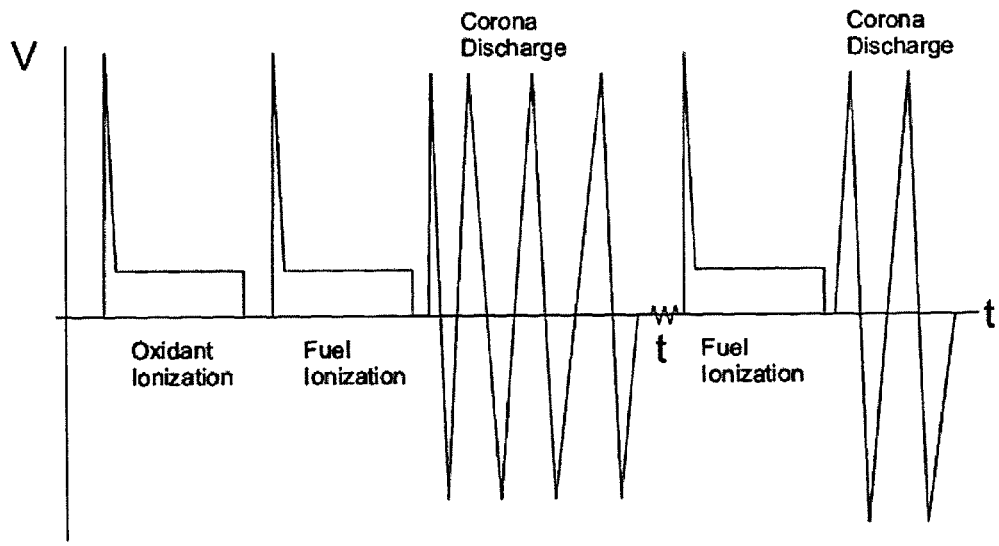
FIGS. 4 and 5 show exemplary voltage and corresponding current plots depicting the timing of events during implementation of the disclosed technology.
Figure 5:
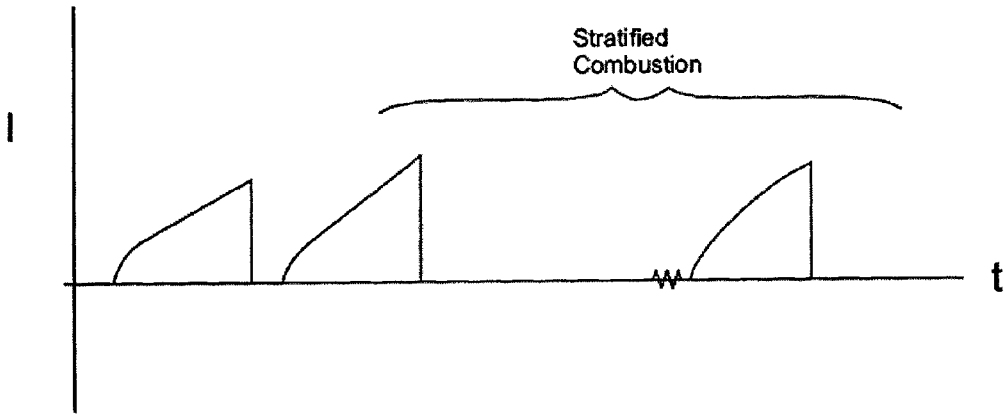

FIGS. 4 and 5 show data plots that illustrate the timing of such events including applications of EMF or voltage "V" in time "t" (FIG. 4) and corresponding current "I" in time "t" (FIG. 5) produced during generation of ions of oxidant followed by generation of fuel ions followed by production of corona discharge in the pattern of ion penetration into the combustion chamber at an adaptively determined frequency.

Figure 6:
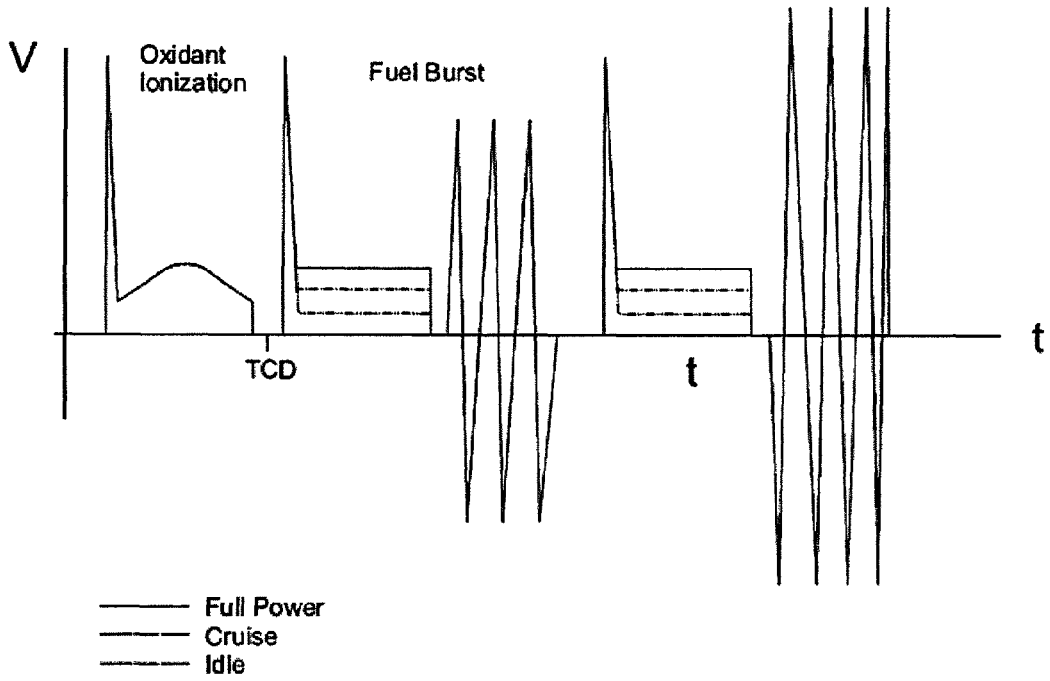
FIGS. 6 and 7 show exemplary data plots depicting the timing of events during implementation of the disclosed technology commensurate to the crank angle timing at various engine performance levels.
Figure 7:
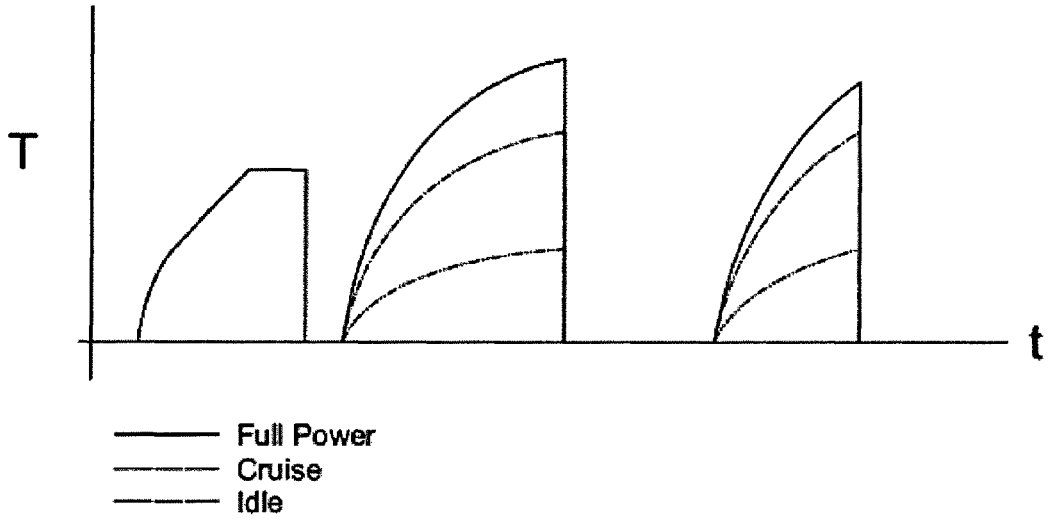

FIGS. 6 and 7 show data plots that depict various adaptive adjustments commensurate with/to the crank angle timing to produce required torque at performance levels such as idle (shown in FIGS. 6 and 7 data plots as -••-), cruise (shown in FIGS. 6 and 7 data plots as -•-), and full power (shown in FIGS. 6 and 7 data plots as -) with minimum fuel consumption by initiation of events, e.g., such as: (1) oxidant activation prior to or following fuel injection by ionization, Lorentz thrusting, and/or corona discharge; (2) fuel particle activation by ionization, Lorentz thrusting, and/or corona discharge; (3) the timing between successive activations of oxidant and fuel particles (e.g., to produce multi bursts of activated fuel thrusts); (4) the launch velocity of each type of activated particle group; and (5) the penetration extent and pattern into oxidant within the combustion chamber.

For example, FIG. 6 can represent the EMF or voltage applied between electrodes such as 320 and 322 beginning with a much higher voltage to initiate an ion current followed by a maintained or reduced voltage magnitude to continue the current growth along the gap between concentric electrode surfaces 320 and 330 commensurate with engine performance levels such as idle, cruise, and full power. Accordingly the oxygen utilization efficiency is higher at full power than at cruise or idle because fuel is launched at higher included angle and at higher velocity to penetrate into a larger volume and more oxygen is activated to complete combustion at the greater fuel rate, while the air utilization efficiency for supplying oxidant and insulation of the combustion events is less at full power compared to cruise and idle power levels.

For example, angular acceleration of the ions and swept particles traversing the gap between electrodes 330 and 320 may be accomplished by various combinations, e.g., such as: (1) magnetic acceleration by applying magnetic fields via electromagnetic windings or circuits inside electrode 330 or outside electrode 320; (2) magnetic acceleration by applying magnetic fields via permanent magnets inside electrode 330 or outside electrode 320; (3) utilization of permanent magnetic materials in selected regions of electrode 320 and/or 330; (4) utilization of one or more curvilinear fins or sub-surface channels in electrodes 330 and/or 322 including combinations such as curvilinear fins on electrode 330 and curvilinear channels in electrode 320 and visa versa to produce swirl that is complementary to swirl introduced within the combustion chamber during intake and/or compression and/or combustion events; and (5) utilization of one or more curvilinear fins or sub-surface channels in electrodes 330 and/or 322 including combinations such as curvilinear fins on electrode 330 and curvilinear channels in electrode 320 and visa versa to produce swirl that is contrary to swirl introduced within the combustion chamber during intake and/or compression and/or combustion events.

FIG. 7 shows representative ion current magnitudes that occur in response to the variations in applied voltage between electrodes 320 and 322. Therefore the launch velocity and penetration pattern including angular and linear vector components is closely related to the applied fuel pressure, ion current, and the distance of acceleration of ions between electrode 322 along electrode surface 330 and the combustion chamber extent of electrode 320.

Figure 8:
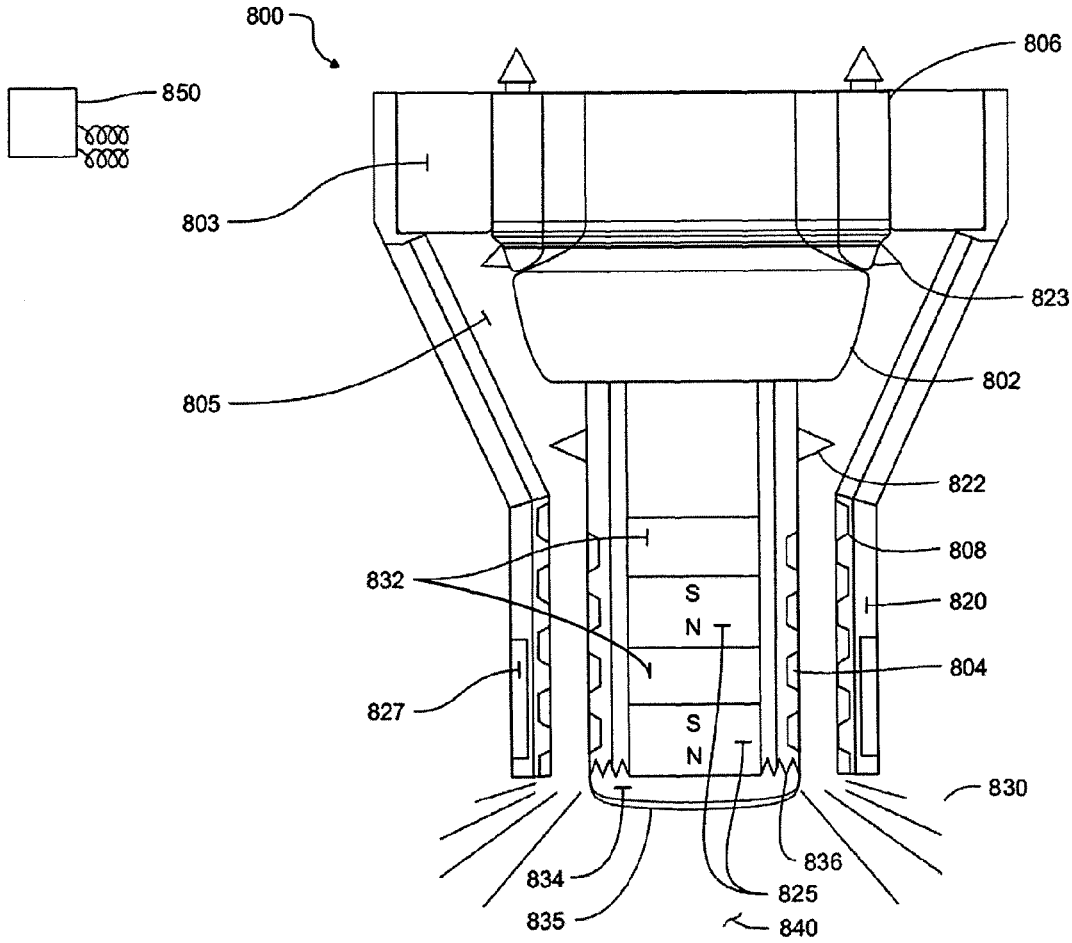
FIG. 8 shows a schematic of another exemplary embodiment of a fuel injection and ignition system.

FIG. 8 shows a cross-sectional schematic view of an embodiment of a fuel injection and ignition system 800. As illustrated in this exemplary embodiment, the system 800 includes a valve seat component 802 and a tubular valve 806 that is axially moved by an actuator, e.g., including but not limited to an electromagnet, piezoelectric, magnetostrictive, pneumatic or hydraulic actuator, away from stationary valve seat 802 along a low friction bearing surface of ceramic insulator 803. This provides for one or more fuel flows into annular space 805 between electrodes 822 and 820 and/or electrodes 823 and 820. For example, before and/or after such fuel flows, an oxidant (e.g., such as air) that enters the annular space 805 may be ionized initially between the annular electrode 822, which can be configured as a ring or series of points, and accelerated linearly and/or in curvilinear pathways by helical fins or channel features 808 and/or 804.

Accordingly, ions of the oxidant and subsequently ions of fuel, along with swept molecules, reach launch velocities that are increased over the magnitudes of starting velocities by the ion currents that are adaptively adjusted by controller 850 for operation of the applied current profile and/or by interaction with electromagnets such as electromagnets 832 and/or permanent magnets 825 and/or permanent magnets 827 according to various combinations and positions as may be desired to operate in various combustion chamber designs to optimize the oxidant and/or fuel ion characterized penetration patterns 830 into combustion chamber 840 for highly efficient production of operating characteristics, e.g., such as high fuel economy, torque, and power production.

In some implementations, a corona discharge may be utilized for fuel ignition without or including occasional operation in conjunction with Lorentz-thrusted ion ignition and combustion in combustion chamber 840. The described system 800 can produce the corona by high frequency and/or other methods for rapid production of an electrical field from electrode region 836 at a rate that is too rapid for spark to occur between electrodes 836 and 820 or narrower gaps, which causes corona discharge of ultraviolet and/or electrons in the pattern 830 as established by swirl acceleration of injected particles and/or ions previously produced by Lorentz thrusting and/or one or more magnetic accelerations.

Protection of the exemplary corona discharge antenna features of the electrode 836 may be provided by a coating of ceramic 834 of a suitable ceramic material and/or reflective coating 835 to block heat gain and prevent oxidation or thermal degradation of the magnets such as the electromagnets 832 and/or the permanent magnets 825 and/or 827. Further heat removal is provided by fluid cooling. For example, fluids traveling under the influence of pressure gradients or Lorentz induced flow through pathways defined by fins or channels can provide highly effective cooling of components, e.g., such as the components 825, 827, 832, and 836.

Figure 9:
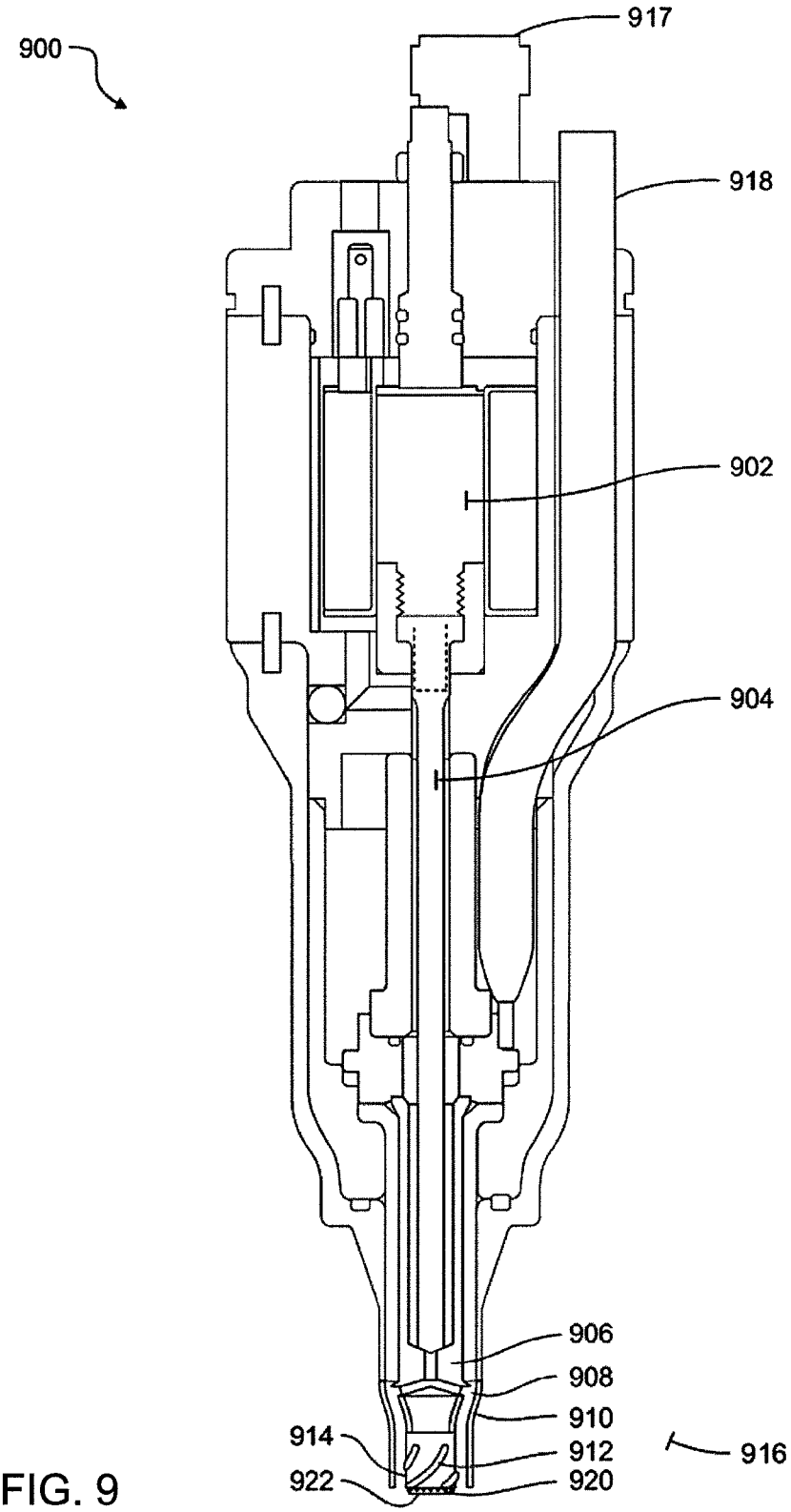
FIG. 9 shows a schematic of another exemplary embodiment of a fuel injection and ignition system.

FIG. 9 shows a cross-sectional view of a schematic of an embodiment of a fuel injection and ignition system 900. In some implementations, the system 900 can be configured to include fuel control valve openings that are radial, inward or outward. As illustrated in an exemplary embodiment, the system 900 includes an actuator 902, e.g., such as an electromagnetic solenoid assembly with armature structure, or a suitable piezoelectric actuator, that forces ceramic valve pin 904 away from conductive seat 906 to provide for adaptively-adjusted fuel pressure to be conveyed from fitting 917 through an internal circuit to ports and upon opening of valve 904 to flow to electrode features, e.g., such as electrode tips 908, into an annular passage between electrodes 910 and 914.

The system 900 includes one or more injection and/or ignition controllers (not shown in FIG. 9, but present in this and other embodiments of the fuel injection and ignition system) that provide electrical power through one or more cables including high voltage cable 918, e.g., to provide valve actuation, Lorentz acceleration, and/or corona discharge). Electrode tips 908 provide a relatively narrow gap and can be configured to include sharp features to initiate ion currents at considerably lower voltage, e.g., such as 15 KV to 30 KV, as compared to 60 KV to 80 KV that would be required for a spark plug with larger gaps needed for lean burn with alternative fuels at the elevated pressure provided in the combustion chambers of modem engines. For example, in ionization applications before fuel flow into the annular space between electrodes 910 and 914, such ion current may be comprised of activated oxidant particles including, but not limited to, $O_3$, O, $OH^-$, $N_2O$, NO, $NO_2$, and/or electrons, etc., and acceleration by Lorentz force into combustion chamber zone 916. For example, in ionization applications after fuel flow into the annular space between electrodes 910 and 914, such ion current may be comprised of activated fuel particles. Illustratively, in the instance that a hydrocarbon such as methane is included in the fuel flow, activated fuel fragments or radicals (e.g., such as $CH_3$, $CH_2$, CH, $H_3$, $H_2$, H, and/or electrons etc.) are accelerated by Lorentz force into the combustion chamber zone 916. The velocity of the fuel ions and other particles that are swept into the combustion chamber 916 is initially limited to the local speed of sound as fuel enters the annular electrode gap, but can be Lorentz accelerated quickly to supersonic magnitudes.

In some examples, one or more fins such as fins 912 may be placed or extended at desirable locations on the electrode 910 and/or the electrode 914, as shown in FIG. 9, to produce swirl flows of ions and other particles that are swept through the annular pathway to the combustion chamber 916. Guide channels and/or fins 912 provide a wide range of entry angles into the combustion chamber 916 to meet various geometric considerations for oxidant utilization in combined roles of expedited fuel combustion and insulation of the heat produced to provide high-efficiency conversion of stratified charge heat into work during the power stroke of the engine.

In some implementations, the system 900 can incorporate at least some of the components and configurations of the system 800, e.g., arranged at the terminal end of the system 900. For example, the system 900 can include components similar to 825, 827, and/or 832. Control of the Lorentz thrust current as it interacts with the variable acceleration by permanent and/or electromagnets (e.g., within the electrode 914 similar to the arrangements with magnets 825 and/or 832 along with 827 installed on the electrode 910), electrode gaps of channel and/or fin locations and proportions of fuel flow provided in channels compared to other zones for total flow thus enables an extremely large range of adjustable penetration magnitudes and patterns to optimize operation in modes such as idle, acceleration, cruise, and full power. This provides an adaptable range of launch velocities and patterns in response to the variations in electrode gaps and ion current pathways according to the design of channels 804 and/or 808 and/or the outside diameter or inside diameter fins 912. Additional adaptive optimization of fuel efficiency and performance can be provided by choices of Lorentz ion ignition and/or corona ignition from electrode 920 (e.g., which can be configured with electrode antenna 922), along with combinations, e.g., such as Lorentz adjusted penetration patterns that are followed by corona discharge ignition to such patterns to accelerate completion of combustion.

Figure 10A:
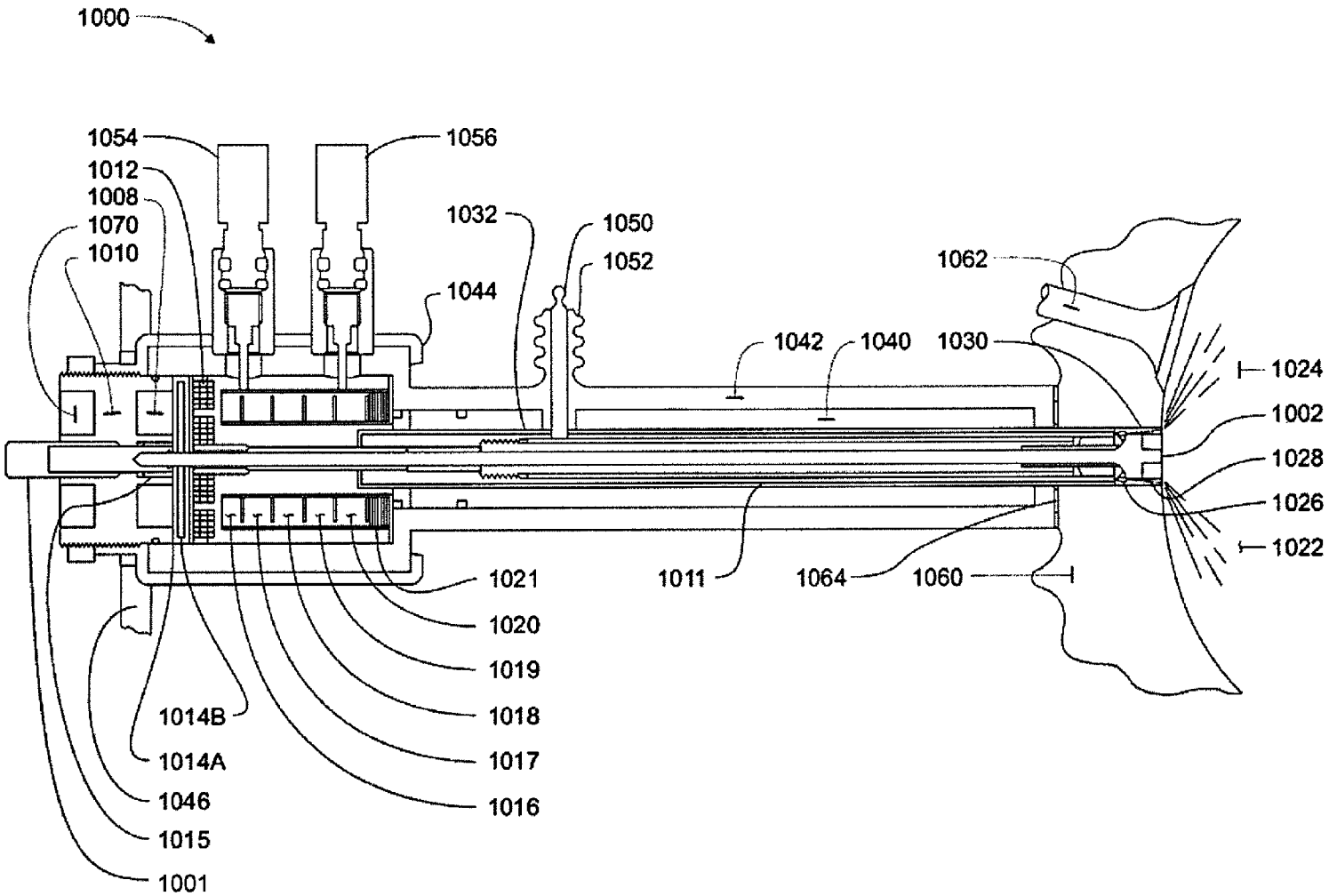
FIGS. 10A-10F show schematics of a system including an assembly of components for converting engines.

FIG. 10A shows embodiment of a system 1000 including an assembly of components for converting heat engines, e.g., such as piston engines, to operation on gaseous fuels. A representative illustration of such engines includes a partial section of a portion of combustion chamber 1024 including engine head portion 1060, an inlet or exhaust valve 1062 (e.g., generally typical to two or four valve engine types), a glass body 1042, adapter encasement 1044 and a section of an engine hold down clamp 1046 for assembling the system 1000 in a suitable port through the casting of engine head portion 1060 to the combustion chamber 1024. A suitable gasket, O-ring assembly, and/or or washer 1064 may be utilized to assure establishment of a suitable seal against gas travel out of the combustion chamber 1024.

Glass body 1042 may be manufactured to include development of compressive surface forces and stress particularly in the outside surfaces to provide long life with adequate resistance to fatigue and corrosive degradation. Contained within the glass body 1042 are additional components of the system 1000 for providing combined functions of fuel injection and ignition by one or more technologies. For example, actuation of fuel control valve 1002, which operates by axial motion within the central bore of an electrode 1028 for the purpose of opening outward and closing inward, may be by a suitable piezoelectric, magnetostrictive, or solenoid assembly. FIG. 10A shows a fuel inlet tube fitting 1001 to enable the system 1000 to fluidically couple to other fluid conduits, tubes, or other devices, e.g., to provide fuel to the system 1000.

For the purpose of illustration, an electromagnetic-magnetic actuator assembly is shown as an electromagnet 1012, one or more ferromagnetic armature disks 1014A and 1014B, a guide and bearing sleeve 1015 (e.g., of the armature disk 1014A), and electromagnet and/or permanent magnet 1008. For example, in operation, after magnetic attraction reaches saturation of disk 1014A, disk 1014B is then closed against disk 1014A. The armature disk 1014A can be guided and slide axially on the friction-minimizing guide and bearing sleeve 1015. The armature disk 1014A is attached to the armature disk 1014B by one or more suitable stops such as riveted bearings that allow suitable axial travel of disk 1014B from 1014A to a preset kinetic drive motion limit. In the normally closed position of valve 1002, disk 1014A is urged toward magnet 1008 to thus exert closing force on valve 1002 through a suitable head on the valve stem of valve 1002 as shown, and disk 1014 B is closed against the face of disk 1014A. Establishing a current in one or more windings of electromagnet 1012 produces force to attract and produce kinetic energy in disk 1014B which then suddenly reaches the limit of free axial travel to quickly pull disk 1014A along with valve 1002 to the open position and allow fuel to flow through radial ports near electrode tips 1026.

Figure 10B:
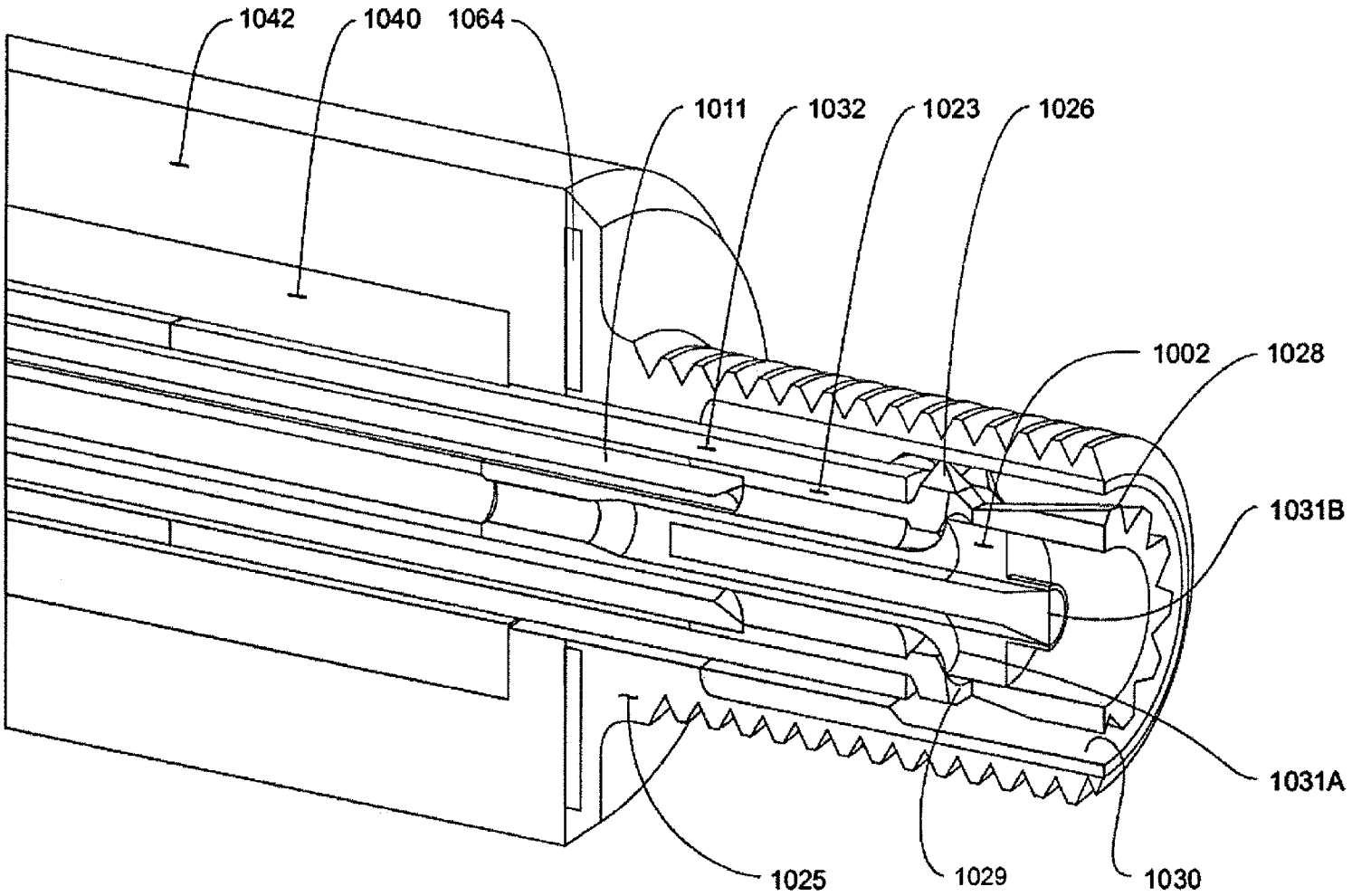
Figure 10C:
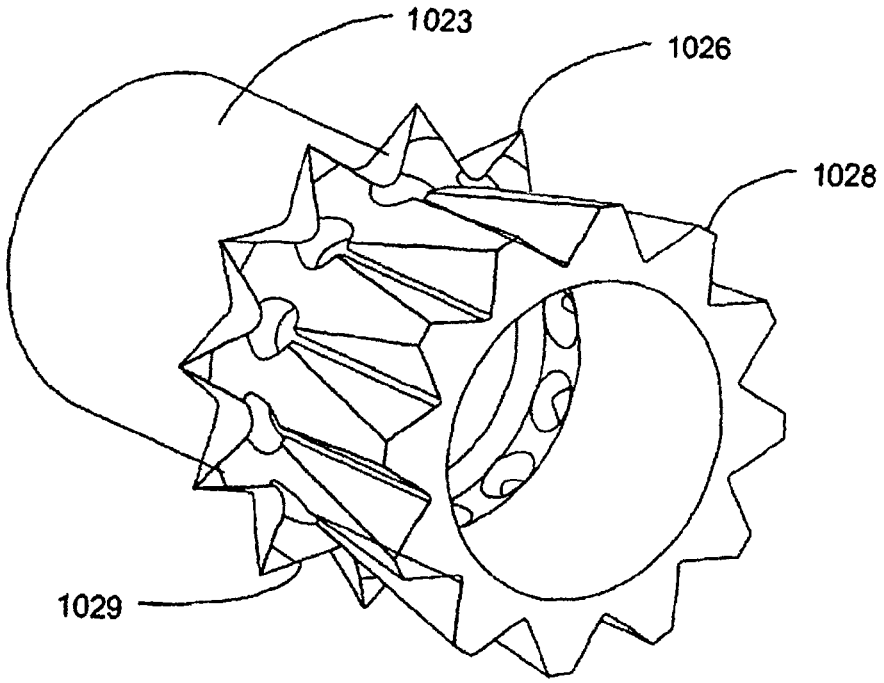
Figure 10D:
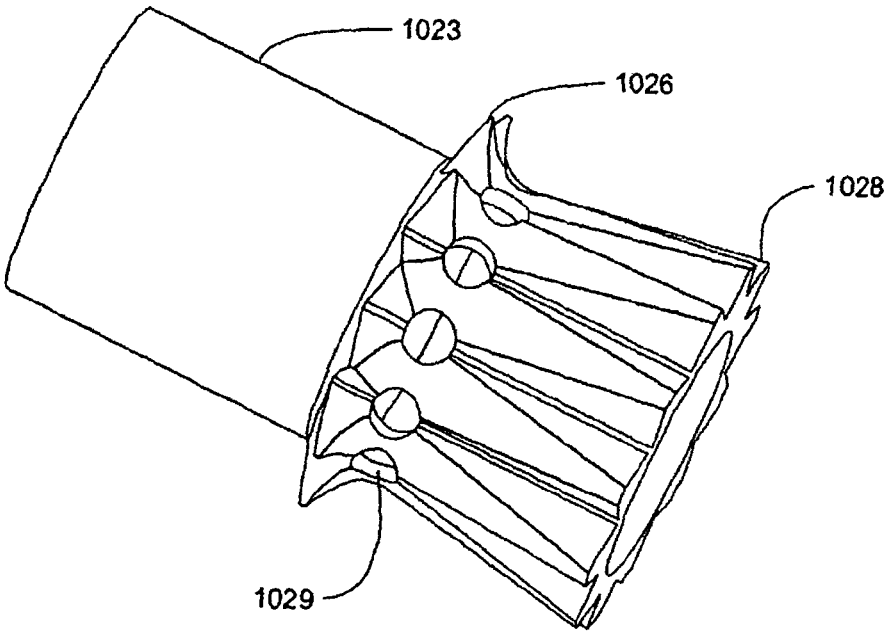
Figure 10E:
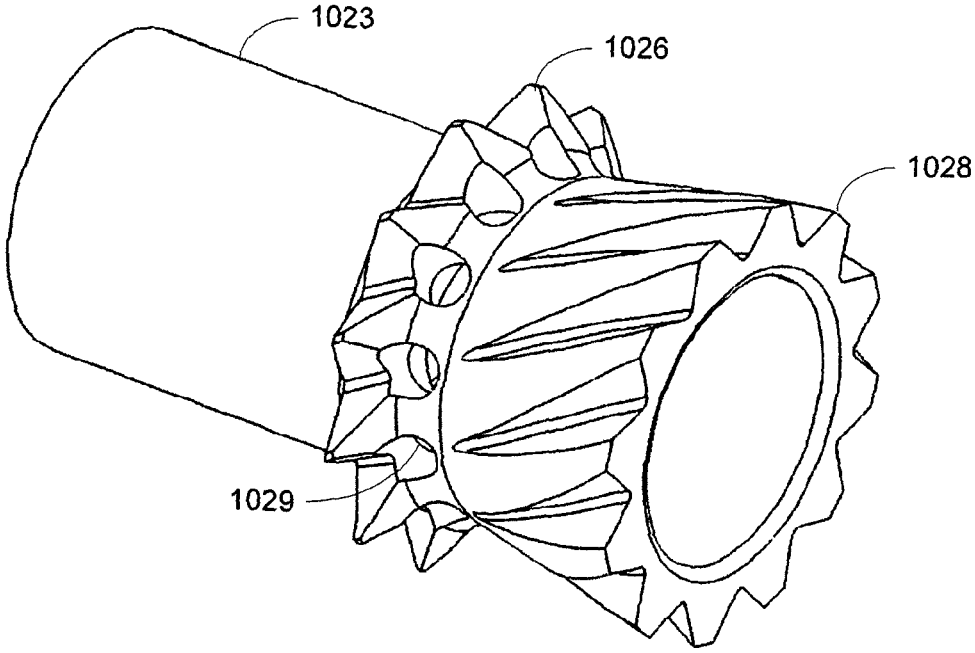
Figure 10F:
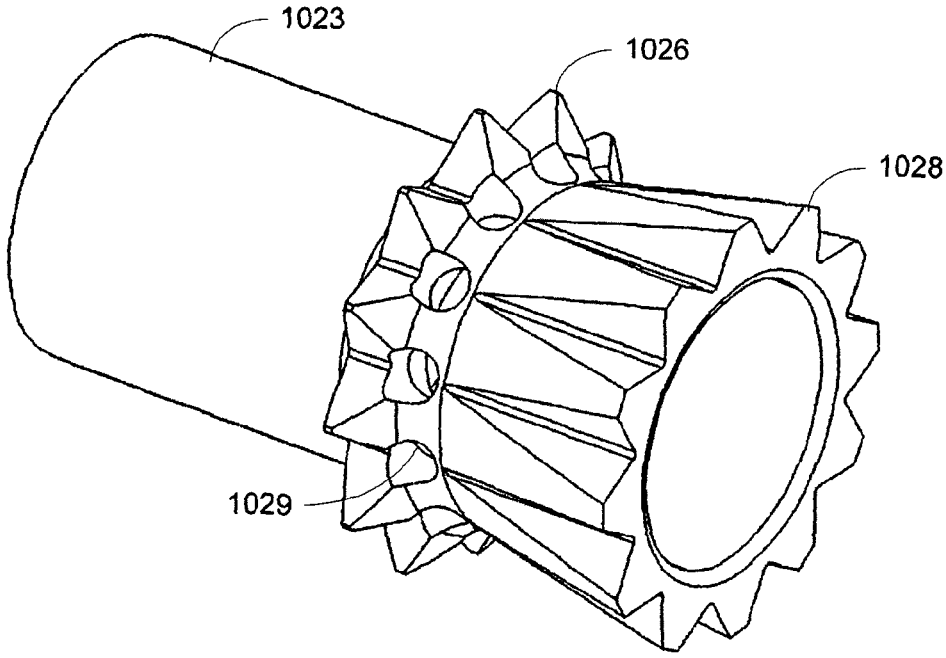

FIG. 10B shows an enlarged view of the components of the system 1000 that are near the combustion chamber including outward opening fuel control valve 1002, valve seat and electrode component 1023 including electrode tips such as 1026 and various swirl or straight electrodes such as 1028. Also shown in FIG. 10B is an exemplary embodiment of an engine adapter 1025 that is threaded into a suitable port to provide secure support for the seal 1064 and to serve as a replaceable electrode 1030. FIG. 10B shows sensors 1031A and 1031B configured with the fuel control valve 1002, which are described in further detail later. FIGS. 10C and 10D show additional views of an illustrative version of the valve seat and electrode component 1023. FIGS. 10E and 10F show additional views of an illustrative version of the valve seat and electrode component 1023 featuring various swirl and straight electrodes such as the electrode 1028. Referring to FIG. 10B, during the normally closed time that fuel flow is prevented by the valve 1002, ionization of an oxidant (e.g., such as air) may occur according to process instructions provided from computer 1070. During intake and/or compression events in combustion chamber 1024, air admitted into the annular space between electrodes 1026/1028 and electrode 1030 is ionized to form an initial current between electrode tips 1026 and electrode 1030. This greatly reduces the impedance, and much larger current is produced along with Lorentz force to accelerate the growing population of ions that are thrust into combustion chamber 1024 in controllable penetration patterns 1022.

Similarly, at times that valve 1002 is opened to allow fuel to flow through ports 1029 into the annular space between electrodes 1026/1028 and electrode 1030, fuel particles are ionized to form an initial current between electrode tips 1026 and 1030. This greatly reduces the impedance, and much larger current can be controllably produced along with greater Lorentz force to accelerate the growing population of ions that are thrust into combustion chamber 1024. Such ions and other particles are initially swept at sub-sonic or at most sonic velocity, e.g., because of the choked flow limitation past valve 1002. However Lorentz force acceleration along electrodes 1030 and 1028 can be controlled to rapidly accelerate the flow to sonic or supersonic velocities to overtake slower populations of oxidant ions in combustion chamber 1024.

High voltage for such ionization and Lorentz acceleration events may be generated by annular transformer windings in cells 1016, 1017, 1018, 1019, 1020, etc., starting with current generation by pulsing of inductive coils 1012 prior to application of increased current to open armatures 1014A and 1014B and valve 1002. One or more capacitors 1021 may store the energy produced during such transforming steps for rapid production of initial and/or thrusting current levels in ion populations between electrodes 1026/1028 and 1030.

In some implementations, corona discharge may be produced by a high rate of field development delivered through conductor 1050 or by very rapid application of voltage produced by the transformer (e.g., via annular transformer windings in cells 1016 1017, 1018, 1019, 1020, etc.), and stored in capacitor 1040 to present an electric field to cause additional ionization within combustion chamber 1024 including ionization in the paths established by ions thrust into patterns by Lorentz acceleration.

High dielectric strength insulator tube 1032 may extend to the zone within capacitors 1021 to assuredly contain high voltage that is delivered by a conductive tube 1011 including electrode tips 1026 and tubular portion 1028 as shown. Thus the dielectric strength of the glass case 1042 and the insulator tube 1032 provides compact containment of high voltage accumulated by the capacitor 1040 for efficient discharge to produce corona events in combustion chamber 1024. In some implementations, selected portions of glass tube 1042 may be coated with a conductive layer of aluminum, copper, graphite, stainless steel or another RF containment material or configuration including woven filaments of such materials.

In some implementations, the system 1000 includes a transition from the dielectric glass case 1042 to a steel or stainless steel jacket 1044 that allows application of the engine clamp 1046 to hold the system 1000 closed against the gasket seal 1064. For example, the jacket 1044 can include internal threads to hold externally threaded cap assembly 1010 in place as shown.

System 1000 may be operated on low voltage electricity that is delivered by cable 1054 and/or cable 1056, e.g., in which such low voltage is used to produce higher voltage as required including actuation of piezoelectric, magnetostrictive or electromagnet assemblies to open valve 1002 and to produce Lorentz and/or corona ignition events as previously described. Alternatively, for example, the system 1000 may be operated by a combination of electric energy conversion systems including one or more high voltage sources (not shown) that utilize one or more posts such as the conductor 1050 insulated by a glass or ceramic portion 1052 to deliver the required voltage and application profiles to provide Lorentz thrusting and/or corona discharge.

This enables utilization of Lorentz-force thrusting voltage application profiles to initially produce an ion current followed by rapid current growth along with one or more other power supplies to utilize RF, variable frequency AC or rapidly pulsed DC to stimulate corona discharge in the pattern of oxidant ion and radical and/or swept oxidant injection into combustion chamber 1024, as well as in the pattern of fuel ions and radicals and/or swept fuel particles that are injected into combustion chamber 1024. Accordingly, the energy conversion efficiencies for Lorentz and/or for corona ignition and combustion acceleration events are improved.

Figure 11A:
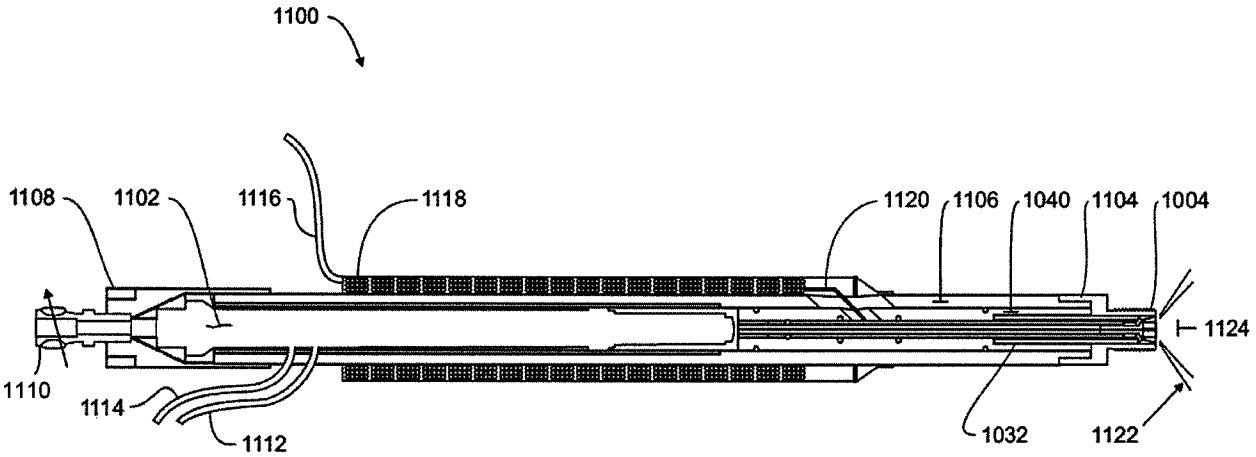
FIGS. 11A-11C show schematics of another embodiment of a system for converting heat engines.

FIG. 11A shows a schematic of another embodiment of a system 1100 for converting heat engines that includes features and components similar to those of the system 1000 introduced by FIGS. 10A and 10B. In the exemplary embodiment of system 1100, a suitable metal alloy terminal component 1104 is provided that forms a cylindrical shape of dimensions to replace a diesel fuel-injector, or in other versions, the component 1104 may be threaded to allow replacement of a sparkplug as shown. The system 1100 includes an insulator glass sleeve 1106 that provides insulation of one or more capacitors 1040 in the annular spaces within the insulator glass sleeve 1106. The system 1100 includes a piezoelectric driver assembly 1102 that actuates a valve assembly 1004. Portions of the valve assembly 1004 are shown in more detail in the section view in FIG. 11B, including the valve seat and electrode 1023, the insulator sleeve 1032, the conductor tube 1011, and one of the capacitors 1040.

Figure 11B:
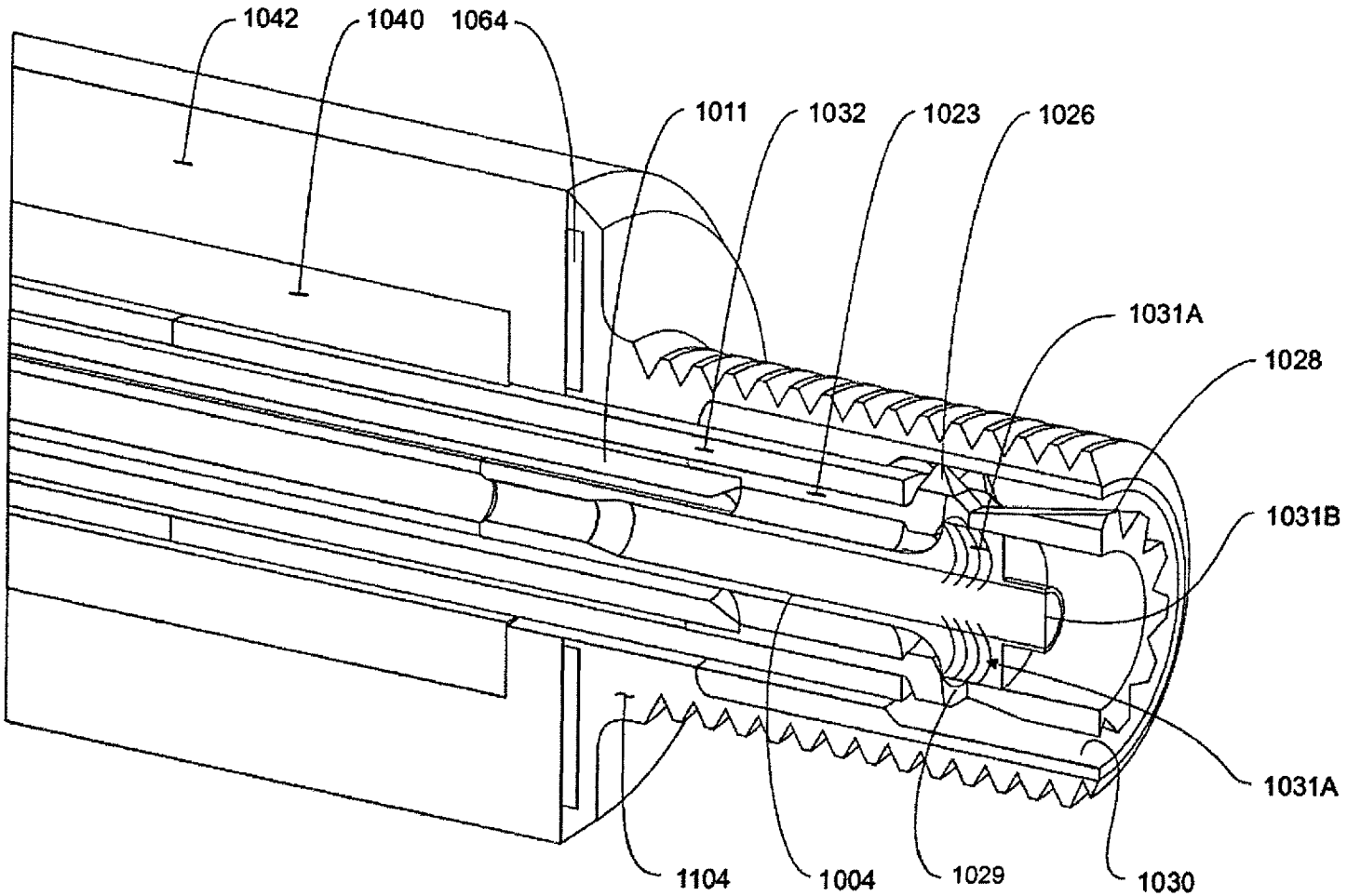

Pressurized fuel is connected to a variable pressure regulator 1110 of the system 1100 and delivered for flow through axial grooves surrounding the exemplary hermetically sealed piezoelectric assembly 1102, e.g., including bellows sealed direct conveyance of push-pull actuation by the valve actuator 1102 and the valve assembly 1004, which can include, for example, an electrically insulative valve stem tube such as silicon nitride, zirconia or composited high strength fiber optics, e.g., such as glass, quartz or sapphire as shown including a representative portion of sensors 1031A and 1031B in FIG. 11B.

For example, such fuel flow cools the exemplary piezoelectric actuator 1102 and valve train components along with the valve seat and guide electrode component 1023 and related components to minimize dimensional changes due to thermal expansion mismatches. The system 1100 includes a controller 1108 for system operations including operation of the exemplary piezoelectric actuator 1102. The controller 1108 (as well as the controller 1008 of FIG. 10A and other controllers of the disclosed technology) can be configured to overcome any flow error due to any elastic strain and such thermal expansion mismatch, e.g., as detected by instrumentation as relayed by sensor 1031A filaments to monitor the various positions from closed to various voltage proportional valve to seat gap positions or measurements and/or in response to flow monitoring instrumentation in the insulator sleeve 1032 and/or fuel injection and combustion pattern detection in the combustion chamber by instrumentation and fiber optic relay 1031B. For example, any error in actual compared to commanded fuel flow including ion induced oxidant flows can be immediately compensated by adaptive pressure control and/or voltage control adjustments of the exemplary piezoelectric driver 1102, e.g., including adaptive adjustment and application of negative voltage to positive voltage bias as may be needed.

Figure 11C:
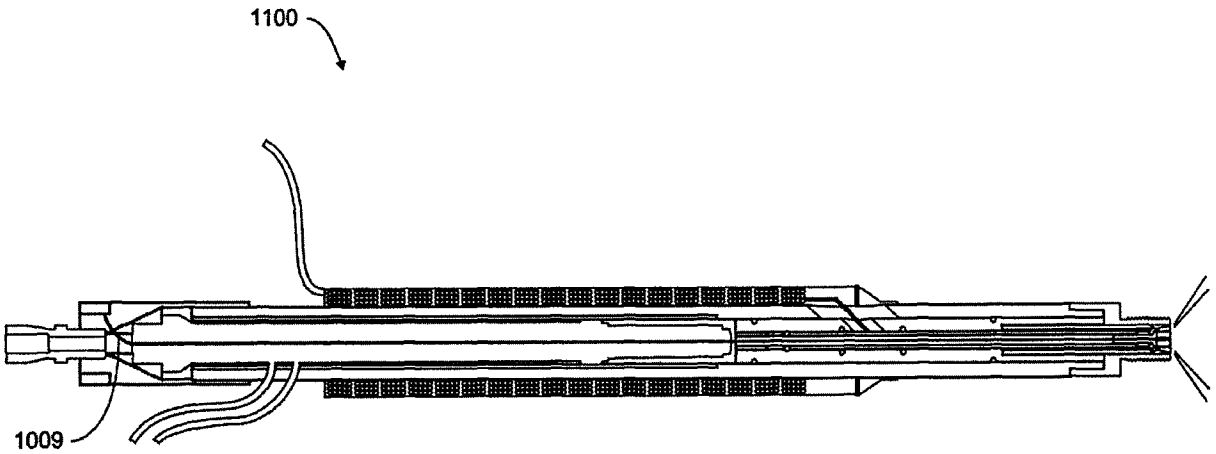

The system 1100 includes a controller 1108 for operation of the exemplary piezoelectric actuator 1102, in which can be configured to be in communication with the controller 1108 by a suitable communications path. For example, in some applications, fiber optic filaments are routed through the hermetically sealed central core of the valve assembly continuing through the hermetically sealed core of the piezoelectric assembly and axial motion is compensated by slight flexure of the fiber optics in a path to the controller (e.g., such as controller 1108 or 1008) and/or some or all of the fiber optic filaments may be routed from the controller through one or more of the grooves that fuel flows through to slightly flex to accommodate for reciprocation of the fuel valve assembly. FIG. 11C shows a schematic view of the system 1100 including an optical fiber path 1009 to/from the controller and the piezoelectric actuator assembly.

For example, the system 1100 can be operated using commands from the controller 1108 to operate the exemplary piezoelectric actuator 1102 by application through insulated cables 1112 and 1114 of adaptively variable voltage ranging from, for example, −30 VDC to about +220 VDC. For example, voltage applied to the piezoelectric actuator 1102 can be adaptively adjusted to compensate for thermal expansion differences between stationery components and dynamic components, e.g., such as the valve stem and other components of valve assembly 1004. For example, such adaptive adjustments can be made in response to combustion chamber fuel pattern and combustion characterization detection by various sensors, e.g., such as sensors 1031A and 1031B within the system 1100, and/or sensors in the head gasket and/or fiber optic position sensors within insulator sleeve 1032 of the valve 1004 that detect the distance of separation between the valve seat and electrode component 1023 and the valve 1004, along with flow through ports 1029 to the combustion chamber 1024.

The controller 1108 also provides control and excitation through the cable 1116 of coil assembly 1118 to produce high voltage that is delivered through insulated conductor 1120 to the conductor tube 1011, the one or more capacitors such as the capacitor(s) 1040 in the annular space within the insulator glass sleeve 1106, and subsequently to the valve seat and electrode 1023 to energize electrodes 1026 and/or 1028 and 1030 for production of spark, Lorentz-thrusted ions, and/or corona ignition discharge in the fuel injection penetration pattern within combustion chamber 1124. In some implementations, for example, the controller 1108 can utilize at least one of the circuits disclosed in U.S. Pat. Nos. 3,149,620; 4,122,816; 4,402,036; 4,514,712; 5,473,502; US2012/0180743 and related references that have cited such processes, and all of these documents are incorporated by reference in their entirety.

The disclosed systems, devices and methods can be implemented to provide Lorentz-thrusted ion characterized penetration patterns in the combustion chamber to adaptively adjust the timing including repeated occurrences of corona discharge in one or more patterns established by Lorentz initiated and launched ions. Such target or pilot ions greatly reduce the corona energy requirements and improve the efficiency of corona discharge ignition including placement of corona energy discharges of ultraviolet radiation and/or production of additional ions in the patterns of fuel and air mixtures to accelerate initiation and completion of combustion events. Additional exemplary techniques, systems, and/or devices to produce a Lorentz force is described in U.S. patent application entitled "FUEL INJECTION SYSTEMS WITH ENHANCED THRUST", filed on or before Mar. 15, 2013, which is incorporated by reference in its entirety as part of the disclosure in this patent document.

In some aspects of the disclosed technology, for stratified charge fuel combustion, corona ignition efficiency can be substantially higher if electrical energy is spent on corona-induced ionization and/or generation of ionizing radiation, e.g., such as ultraviolet radiation in the location of fuel and oxidant mixtures. For example, suitable mixtures can include oxidants such as air, oxygen, other donors of oxygen, and various halogens. Illustratively, for example, mixtures that provide improved corona ignition efficiency include: (1) fuel, fuel ions, and oxidant; (2) oxidant ions and fuel; and (3) oxidant ions, oxidant, fuel, and fuel ions.

In some implementations, for example, corona discharge in the pattern of injected fuel penetration can be assured if the pattern contains or includes oxidant ions, ozone, oxides of nitrogen and/or other activated oxidant particles. Similarly, corona discharge in the pattern of injected fuel can be assured if the injected fuel pattern contains or includes ions, ozone, oxides of nitrogen, and other activated oxidants or fuel radicals.

Corona discharge efficiency can also be improved if the injected fuel includes easily ionized inert gases, e.g., such as helium, argon, neon, krypton, or xenon, because such gases are ionized at much lower applied voltage and electrical energy expenditure than nitrogen, oxygen or fuel particles such as hydrocarbons (e.g., including methane, ethane, propane, butane, gasoline or diesel fuel). Similar exemplary improvements in corona ignition efficiency can be gained by mixing such inert gases with the oxidant that is presented in the pattern that fuel and oxidant are mixed.

Exemplary inert gases that have much lower dielectric strength and are more easily ionized than air or hydrocarbon fuels are presented in Table 1. For example, gases such as the argon group including lesser amounts of neon, krypton, and xenon comprise about 1% of the atmosphere. Argon along with such lesser amounts of such inert gases can be separated from air by selective sorption and release, liquefaction and selective vaporization, or by various suitable filtration systems. Helium can be extracted by similar processes from natural gas. Small amounts of such inert gases mixed with fuel such as natural gas that is injected to form a stratified charge presents an energy saving pattern for very high efficiency corona discharge ignition.

TABLE 1

| Corona Suseptability Comparison | |
|---|---|
| SUBSTANCE | RELATIVE DIELECTRIC STRENGTH |
| Air | 0.97 |
| Argon | 0.18 |
| Carbon Dioxide | 0.82-0.88 |
| Carbon Monoxide | 1.02-1.05 |
| Chlorine | 1.55 |
| Helium | 0.15 |
| Hexafluoroethane | 1.82-2.55 |
| Hydrogen | 0.50 |
| Methane | 1.00-1.13 |
| Nitrogen | 1.00 |
| Nitrous Oxide | 1.24 |
| Octafluoropropane | 2.19-2.47 |
| Sulfur Hexafluoride | 2.50-2.63 |
| Tetrachloromethane | 6.21-6.33 |

For example, hydrogen provides an excellent target for efficient corona triggering ignition because it has about ½ the dielectric strength of natural gas, and after efficient corona ignition, hydrogen combusts and releases heat 9 to 15 times faster after ignition to greatly accelerate combustion of natural gas. In another example, hydrogen, natural gas, and small amounts of helium or argon provides triggering ignition of natural gas at substantially higher corona discharge efficiency.

In another example, even higher corona ignition efficiency can be achieved by a mixture of hydrogen and small additions of argon or helium. Such stratified hydrogen combustion can clean the air entering an engine and reduce or eliminate pollen, tire particles, diesel soot, carbon monoxide, ozone, oxides of nitrogen, and carcinogenic agents, e.g., such as peroxyacetyl nitrate, benzene and other unburned hydrocarbons, along with other objectionable constituents of polluted ambient air in congested traffic areas.

Additionally, for example, Lorentz acceleration including ionization of particles that create a current that is subsequently thrust by generation of Lorentz force can be similarly more efficient for substances with relatively lower dielectric strength. Upon being thrust into oxidant within a combustion chamber, such Lorentz thrust ions present particularly efficient opportunities for corona discharge to accelerate ignition and/or completion of combustion.

In some implementations, for example, the disclosed technology can utilize the inert gases (that are extracted from atmospheric air or natural gas) for triggering more efficient Lorentz acceleration and/or corona ignition, which are released from the engine's exhaust with no net impact on the air quality. Utilization of such triggering agents can allow a net improvement in air quality by facilitating much higher fuel efficiency by engines that utilize these embodiments as disclosed.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

I claim:

1. A method to ignite a fuel in an engine, the method comprising:

injecting ionized fuel particles in a pattern within a combustion chamber of an engine; and generating one or more corona discharges at a predetermined location within the combustion chamber to ignite the injected ionized fuel particles, the generating including applying an electric field at electrodes configured at a port of the combustion chamber, the electric field applied at a frequency that does not produce an ion current or spark on or between the electrodes.

2. The method of claim 1, wherein the corona discharge initiates a combustion process of the ionized fuel particles with oxidant compounds present in the chamber.

3. The method of claim 1, wherein the electrodes include antenna structures interfaced at the port.

4. The method of claim 1, wherein the electrodes include a first electrode and a second electrode configured in a coaxial configuration at a terminal end interfaced with the port, in which the first electrode is configured along the interior of an annular spacing between the second electrode and the first electrode includes one or more points protruding into the annular spacing.

5. The method of claim 4, wherein the second electrode includes one or more points protruding into the annular space and aligned with the one or more points of the first electrode to reduce the spacing between the first and second electrode.

6. The method of claim 1, wherein the injecting includes:

distributing a fuel between the electrodes, ionizing at least some of the fuel by generating an electric field between the electrodes to produce the ionized fuel particles, and producing a Lorentz force to accelerate the ionized fuel particles into the combustion chamber.

7. The method of claim 6, wherein the Lorentz force accelerates the ionized fuel particles into the chamber in a striated pattern.

8. The method of claim 7, wherein the particular location of the generated one or more corona discharges includes a distance from the port in the combustion chamber based on the striated pattern of the accelerated ionized fuel particles.

9. The method of claim 6, wherein the ionized fuel particles are accelerated into the combustion chamber at a speed within a range of 0.2 mach to 10 mach.

10. The method of claim 1, further comprising injecting ionized oxidant particles into the combustion chamber, the injecting including:

dispersing air including oxidant particles between the electrodes, ionizing at least some of the oxidant particles by generating an electric field between the electrodes to produce the ionized oxidant particles, and producing a Lorentz force to accelerate the ionized oxidant particles into the combustion chamber.

11. The method of claim 10, wherein the Lorentz force accelerates the ionized oxidant particles into the chamber in a striated pattern.

12. The method of claim 11, wherein the particular location of the generated one or more corona discharges includes a distance from the port in the combustion chamber based on the striated pattern of the accelerated ionized oxidant particles.

13. The method of claim 10, wherein the ionized oxidant particles are accelerated into the combustion chamber at a speed within a range of 0.2 mach to 10 mach.

14. The method of claim 10, wherein the oxidant include at least one of oxygen gas ($O_2$), ozone ($O_3$), oxygen atoms (O), hydroxide ($OH^-$), carbon monoxide (CO), or nitrous oxygen ($NO_x$).

15. The method of claim 1, wherein the one or more corona discharges are generated in a striated pattern.

16. The method of claim 1, wherein the generated one or more corona discharges include a nanosecond range duration.

17. The method of claim 1, wherein the fuel includes at least one of methane, natural gas, an alcohol fuel including at least one of methanol or ethanol, butane, propane, gasoline, diesel fuel, ammonia, urea, nitrogen, or hydrogen.

18. A method to combust a fuel in an engine, the method comprising:

injecting ionized oxidant particles in a pattern within a combustion chamber of an engine, the combustion chamber having a fuel present; and generating one or more corona discharges at a predetermined location within the combustion chamber to ignite the injected ionized oxidant particles, the generating including applying an electric field at electrodes configured at a port of the combustion chamber, the electric field applied at a frequency that does not produce an ion current or spark on or between the electrodes, wherein the ignited ionized oxidant particles initiate a combustion process with the fuel.

19. The method of claim 18, wherein the injecting includes:

distributing an oxidant between the electrodes, ionizing at least some of the oxidant by generating an electric field between the electrodes to produce the ionized oxidant particles, and producing a Lorentz force to accelerate the ionized oxidant particles into the combustion chamber.

20. The method of claim 18, wherein the Lorentz force accelerates the ionized oxidant particles into the chamber in a striated pattern, and the particular location of the generated one or more corona discharges includes a distance from the port in the combustion chamber based on the striated pattern of the accelerated ionized oxidant particles.

21. A method to combust a fuel in an engine, the method comprising:

injecting inert gas particles in a pattern within a combustion chamber of an engine, the combustion chamber having a fuel and oxidant present; and generating one or more corona discharges at a predetermined location within the combustion chamber to ignite the injected inert gas particles, the generating including applying an electric field at electrodes configured at a port of the combustion chamber, the electric field applied at a frequency that does not produce an ion current or spark on or between the electrodes, wherein the one or more corona discharges initiate a combustion process with the fuel and the oxidant in the combustion chamber.

22. The method of claim 21, wherein the inert gas particles includes at least one of argon, xenon, neon, or helium.

* * * * *